US010675878B2

(12) United States Patent
Ota et al.

(10) Patent No.: US 10,675,878 B2
(45) Date of Patent: Jun. 9, 2020

(54) CARTRIDGE UNIT, CIRCUIT ASSEMBLY AND CARTRIDGE ATTACHING METHOD

(71) Applicant: BROTHER KOGYO KABUSHIKI KAISHA, Nagoya, Aichi (JP)

(72) Inventors: Yoshihiro Ota, Aichi (JP); Keisuke Nishihara, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 31 days.

(21) Appl. No.: 16/115,881

(22) Filed: Aug. 29, 2018

(65) Prior Publication Data

US 2019/0061362 A1 Feb. 28, 2019

(30) Foreign Application Priority Data

Aug. 31, 2017 (JP) ..... 2017-166888

(51) Int. Cl.
*B41J 2/175* (2006.01)
*H01R 43/26* (2006.01)
*H01R 31/06* (2006.01)

(52) U.S. Cl.
CPC ..... *B41J 2/17526* (2013.01); *H01R 31/065* (2013.01); *H01R 43/26* (2013.01)

(58) Field of Classification Search
CPC ..... B41J 3/4075; B41J 15/04; B41J 15/044
See application file for complete search history.

(56) References Cited

U.S. PATENT DOCUMENTS 5,492,420 A * 2/1996 Nunokawa ..... B41J 3/4075 358/1.2
5,934,812 A 8/1999 Nunokawa et al.
(Continued)

FOREIGN PATENT DOCUMENTS

JP 2013-212587 A 10/2013
JP 2016-175193 * 10/2016 ..... B41J 17/36
WO 2006/113753 A2 10/2006

OTHER PUBLICATIONS

Google translation of JP 2016-175193, published on Oct. 2016. (Year: 2016).*

(Continued)

*Primary Examiner* — Huan H Tran
(74) *Attorney, Agent, or Firm* — Scully, Scott, Murphy & Presser, PC

(57) ABSTRACT

A cartridge unit for a printer including a cartridge and a circuit assembly. The circuit assembly includes a base member and a circuit substrate having a memory module and a plurality of second electrical contacts. In a cartridge attached state, the circuit assembly is configured to be in a circuit assembly attached state where the circuit assembly is arranged between the plurality of first electrical contacts of the printer and the particular cartridge side wall, the plurality of first electrical contacts electrically contacting the plurality of second electrical contacts, respectively. In a circuit assembly unattached state, the circuit assembly is not arranged between the plurality of first electrical contacts and the particular cartridge side wall. A thickness of the circuit assembly is larger than a distance between the plurality of first electrical contacts and the particular cartridge side wall in the cartridge attached and the circuit assembly unattached state.

22 Claims, 11 Drawing Sheets

(56) References Cited

U.S. PATENT DOCUMENTS

| | | | | |
|---|---|---|---|---|
| 7,934,881 | B2 * | 5/2011 | Lodwig | B41J 3/50 347/214 |
| 9,102,180 | B2 * | 8/2015 | Suva | B41J 15/044 |
| 10,150,307 | B2 * | 12/2018 | Sakano | B41J 2/325 |
| 2012/0027486 | A1 | 2/2012 | Suva et al. | |
| 2013/0258008 | A1 | 10/2013 | Kanbe et al. | |
| 2019/0030929 | A1 * | 1/2019 | Takahashi | B41J 29/02 |

OTHER PUBLICATIONS

Extended European Search Report dated Feb. 6, 2019 in European Patent Application No. 18 19 1140.5.

* cited by examiner

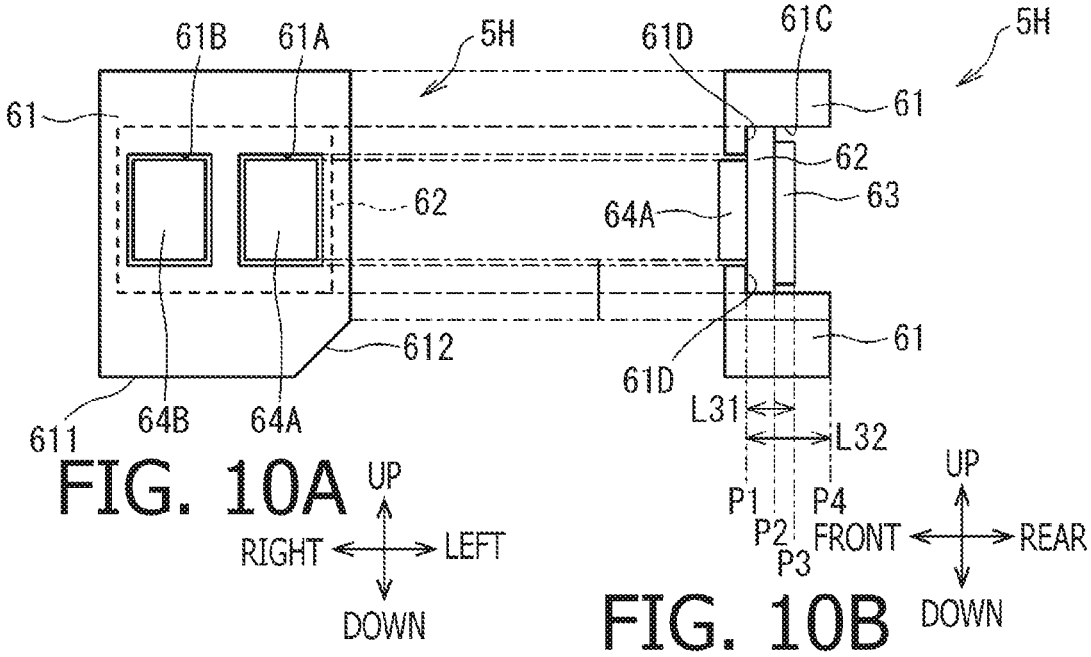
FIG. 10A
FIG. 10B
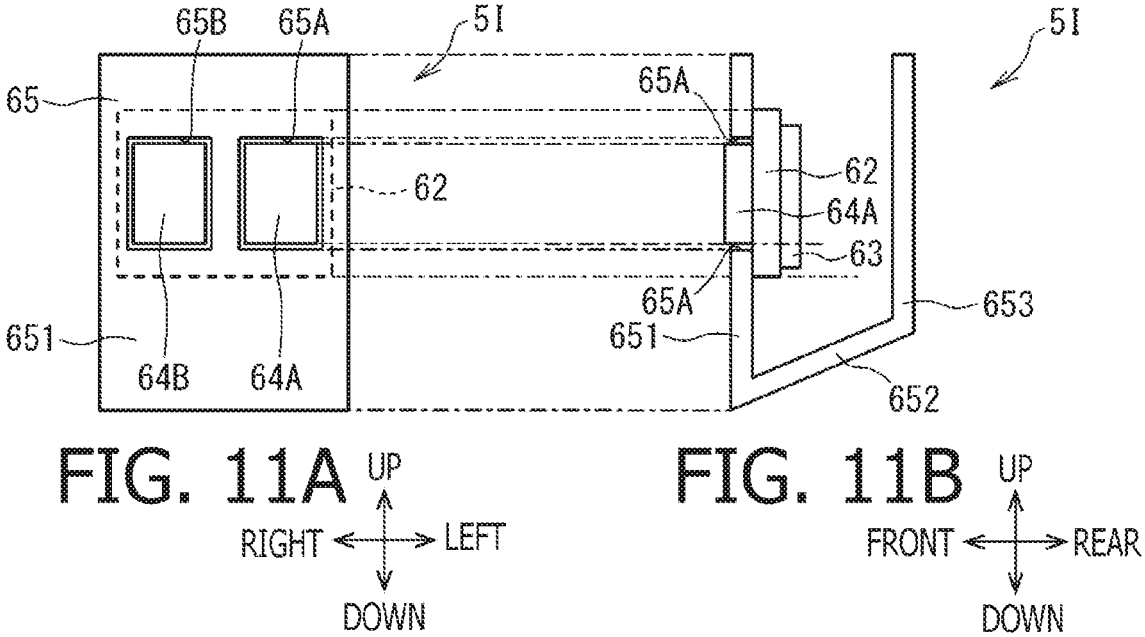
FIG. 11A
FIG. 11B

CARTRIDGE UNIT, CIRCUIT ASSEMBLY AND CARTRIDGE ATTACHING METHOD

CROSS-REFERENCE TO RELATED APPLICATIONS

This application claims priority under 35 U.S.C. § 119 from Japanese Patent Application No. 2017-166888 filed on Aug. 31, 2017. The entire subject matter of the application is incorporated herein by reference.

BACKGROUND

Technical Field

The present disclosures relate to a cartridge unit including a cartridge and a circuit assembly, and is configured to be attached to a printing device, the circuit assembly and an attaching method to attach the cartridge unit to the printing device.

Related Art

There has been known a printing device which is configured such that a cartridge provided with a memory module and electrical contacts. The printing device is electrically connected with the electrical contacts of the cartridge attached to the printing device. The printing device performs a communication through the electrical contacts, and obtains information (hereinafter, referred to as cartridge information) stored in the memory module. The printing device is configured to perform printing in accordance with operation conditions corresponding to the cartridge information as obtained.

SUMMARY

The printing device as described above cannot obtain the cartridge information when a cartridge, which is not provide with the memory module or the contacts, is attached. There is known an adaptor which is provided with an IC substrate mounting an IC and electrodes, and is attachable to a part of the cartridge. In the IC, information related to the cartridge is readably stored. The electrodes are configured to contact electrical contacts provided to the printing device in a state where the adaptor is attached to the cartridge attachment part of the printing device. When such an adaptor is employed, the printing device can obtain the cartridge information from the adaptor even when the cartridge, which is not provided with the memory module and the electrical contacts, is attached.

The above-described conventional adaptor is designed such that only the cartridge is exchanged with the adaptor being kept attached to the printing device. Therefore, a part of the adaptor is coupled to an end part, in a moving direction of the cartridge when the cartridge is attached to the cartridge attachment part. Therefore, when the adaptor is to be exchanged with the cartridge being attached to the cartridge attachment part of the printing device, the cartridge should be detached once from the attachment part, and then the adaptor should be exchanged. Therefore, in the conventional configuration, an exchanging operation of the adaptor with respect to the cartridge attachment part of the printing device is troublesome.

According to aspects of the present disclosures, there is provided a cartridge unit configured to be attachable at a recessed attachment part provided to a printer, the cartridge unit including a cartridge, and a circuit assembly. The cartridge includes a casing having a cartridge bottom wall, a cartridge top wall arranged in parallel with the cartridge bottom wall and four cartridge side walls arranged between the cartridge bottom wall and the cartridge top wall. When the cartridge is in a cartridge attached state in which the cartridge is attached to the attachment part of the printer, the cartridge bottom wall faces a printer bottom wall of the attachment part. A particular cartridge side wall, which is one of the four cartridge side walls, faces a plurality of first electrical contacts provided to a part of a printer side wall of the attachment part and moveably urged toward the particular cartridge side wall. The circuit assembly includes a plate-like base member, and a circuit substrate provided to the base member, the circuit substrate having a memory module storing information and a plurality of second electrical contacts exposed from a one side surface of the base member. When the cartridge is in the cartridge attached state, the circuit assembly is configured to be in a circuit assembly attached state where the circuit assembly is arranged between the plurality of first electrical contacts of the printer and the particular cartridge side wall and in a circuit assembly unattached state where the circuit assembly is not arranged between the plurality of first electrical contacts and the particular cartridge side wall. A thickness of the circuit assembly is larger than a distance between the plurality of first electrical contacts and the particular cartridge side wall in the cartridge attached state and the circuit assembly unattached state.

The circuit assembly of the cartridge unit is arranged between the first electrical contacts of the electrode holder provided to the side wall of the attachment part of the thermal printer and the side wall of the cartridge in the cartridge attached state and the circuit assembly attached state. That is, the circuit assembly is arranged between the side wall of the attachment part of the thermal printer and the side wall of the cartridge, but not between the respective bottom. Therefore, when the circuit assembly in the circuit assembly attached state is detached from the thermal printer, it is unnecessary for the worker to remove the cartridge from the attachment part. Therefore, in the circuit assembly attached state, the worker can easily detach the circuit assembly from the thermal printer and exchange the same.

According to aspects of the present disclosures, there is provided a circuit assembly employed in the cartridge unit described above.

According to aspects of the present disclosures, there is provided a cartridge attaching method of attaching the cartridge and the circuit assembly of the cartridge unit according to the first aspect of the present invention described above. The method includes a first process of attaching the cartridge to the attachment part such that the particular cartridge side wall of the cartridge and a part of the printer side wall of the attachment part of the printer face each other, and a second process of inserting the circuit assembly between the particular cartridge side wall and the plurality of first electrical contacts such that the plurality of second electrical contacts contact the plurality of first electrical contacts, respectively.

According to aspects of the present disclosures, there is provided a circuit assembly employed in a printing system including a thermal printer and a cartridge, the cartridge having a casing provided with a cartridge bottom wall, a cartridge top wall parallel with the cartridge bottom wall, and four cartridge side walls arranged between the cartridge bottom wall and the cartridge top wall, the thermal printer having an attachment part having a recessed shape, a thermal head provided to the attachment part, and a plurality of first electrical contacts, the attachment part having a printer bottom wall facing the cartridge bottom wall in a cartridge attached state in which the cartridge is attached to the thermal printer and a printer side wall, the plurality of first electrical contacts being movably biased toward a particular cartridge side wall which is one of the four cartridge side walls in the cartridge attached state. The circuit assembly is configured to be in a circuit assembly attached state which is a state where the circuit assembly is arranged between the plurality of first electrical contacts of the thermal printer and the particular cartridge side wall of the cartridge in the cartridge attached state. The circuit assembly includes a plate-like base member, and a circuit substrate provided to the base member, the circuit substrate including a memory module storing information, and a plurality of second electrical contacts exposed on a one side surface of the base member. A thickness of the circuit assembly is larger than a distance between the plurality of first electrical contacts and the particular cartridge side wall in the cartridge attached state and in a circuit assembly unattached state where the circuit assembly is not arranged between the plurality of first electrical contacts and the particular cartridge side wall.

BRIEF DESCRIPTION OF ILLUSTRATIVE EMBODIMENT

FIG. 10A is a front view of a circuit assembly according to a seventh embodiment.

FIG. 10B is a side view of the circuit assembly according to the seventh embodiment.

FIG. 11A is a front view of a circuit assembly according to an eighth embodiment.

FIG. 11B is a side view of the circuit assembly according to the eighth embodiment.

EMBODIMENT

A thermal printer 1A is configured to create a label by printing character(s), character string(s), symbol(s), numeral(s), figure(s), pictogram(s) (hereinafter, referred to as printing information) on a tape T (see FIG. 3A) which is a printing medium. In a following description, an upper left side, a lower right side, an upper right side, a lower left side, an upside and a down side of FIG. 1 will be defined as a left side, a right side, a rear side, a front side, a down side and an upside of the thermal printer 1A, respectively. It is noted that the directions of the thermal printer 1A are defined assuming that an attaching part 3 is directed upward (see FIG. 2). Further, an upper right side, a lower left side, an upper left side, a lower right side, a down side and an upside well be defined as a left side, a right side, a rear side, a front side, a down side and an upside of the cartridge unit 1B (i.e., the cartridge 4B and the circuit assembly 5B), respectively. It is noted that the directions of the cartridge unit 1B are defined assuming that the cartridge unit 1B is attached to the attachment part 3 of the thermal printer 1A (see FIG. 4C).

<Thermal Printer>

Figure 1:
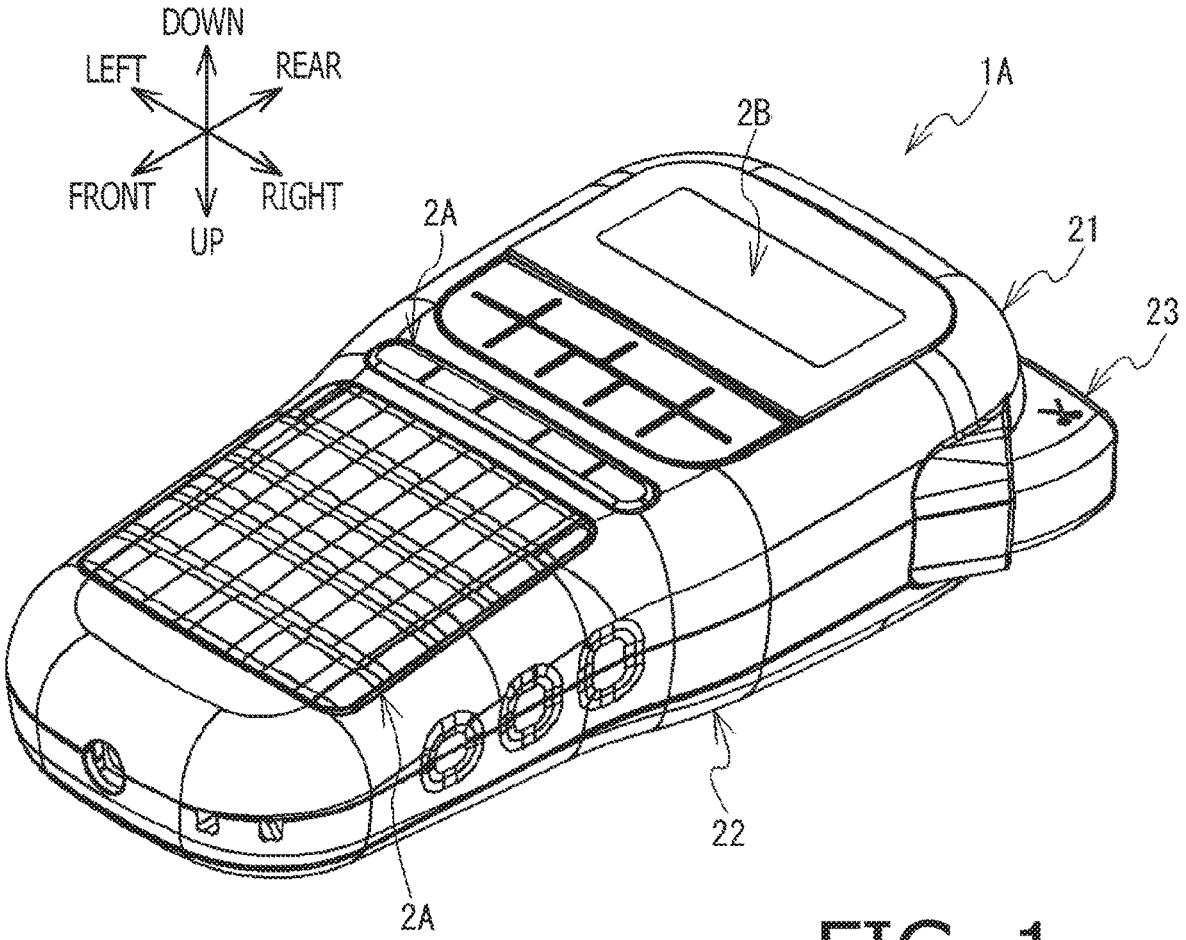
FIG. 1 is a perspective view of a thermal printer viewed from a lower side.

As shown in FIG. 1, the thermal printer 1A has a main body cover 21 which is a box-like cover having a generally rectangular parallelepiped shape. On a lower surface of the main body cover 21, a keyboard 2A for inputting character strings and the like is provided. The keyboard 2A includes a power switch, function keys and cursor keys. On the rear side with respect to the keyboard 2A, a display 2B for displaying various pieces of information is arranged. An example of such a display 2B is a dot matrix LCD. On the upside with respect to the display 2B, a cassette cover 22 which is openable and closeable relative to the main body cover 21 is provided. On a rear surface of the main body cover 21, a discharging port 2C (see FIG. 2) allowing a tape T on which printing has been performed to be discharged to the outside is formed. At a corner on the right and rear side of the main body cover 21, an operation member 23 is provided. When the operation member 23 is depressed inward, a cutting mechanism of the thermal printer 1A operates and a printed portion of the tape T is cut out.

Figure 2:
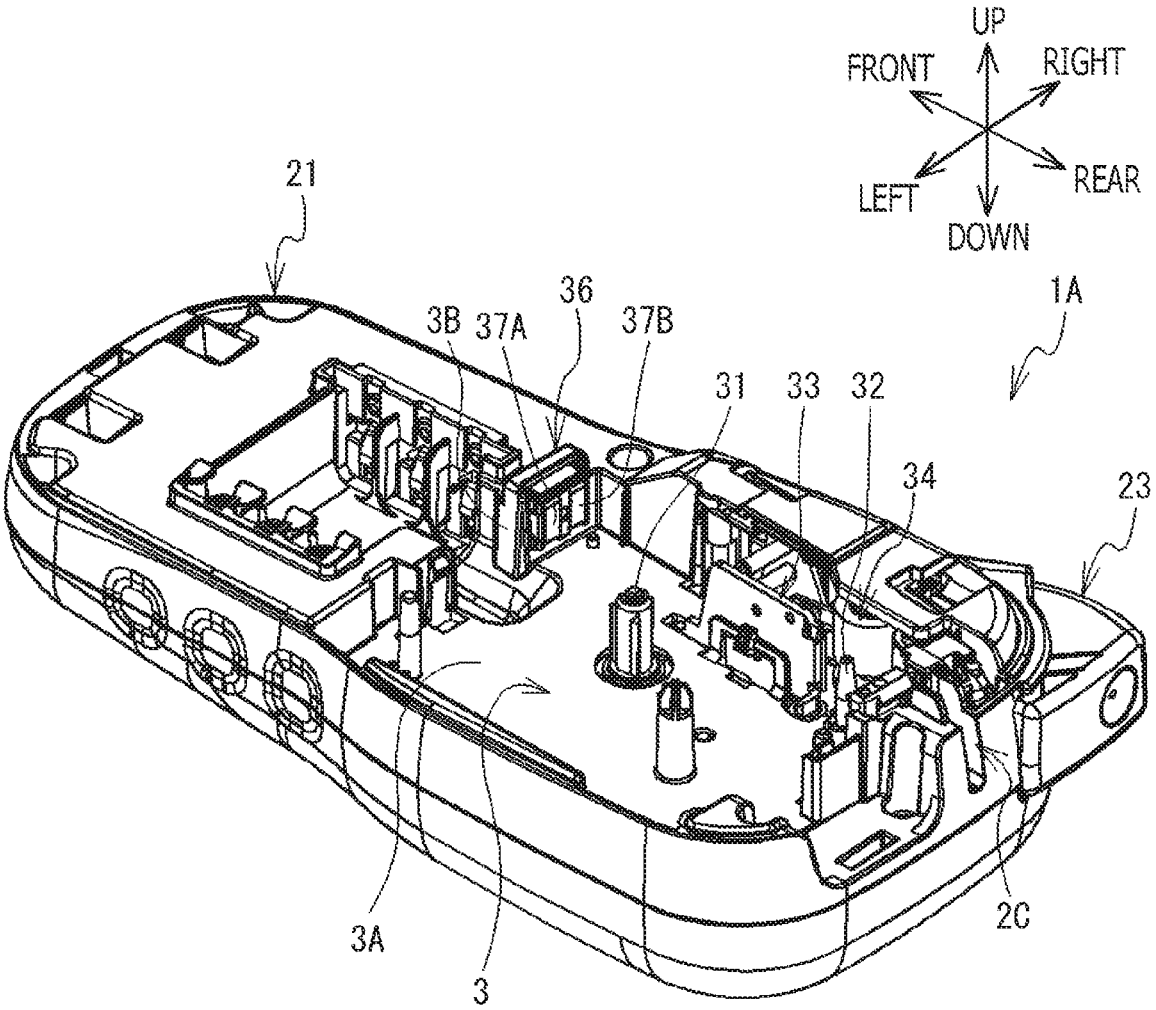
FIG. 2 is a perspective view of the thermal printer viewed from an upper side.

As shown in FIG. 2, the attachment part 3 is provided at a portion of the main body cover 21 corresponding to a lower part of the cassette cover 22 (see FIG. 1). The attachment part 3 is a recess formed from a central part to a rear end part, in the front-rear direction, of the main body cover 21. A cartridge unit 1B (see FIG. 3A) can be detachably attached to the attachment part 3. The thermal printer 1A performs printing of character strings which are input through the keyboard 2A using a cartridge 4B (see FIG. 3A) of the cartridge unit 1B attached to the attachment part 3.

The attachment part 3 has a bottom wall 3A and a side wall 3B. The bottom wall 3A has a substantially rectangular shape, which is substantially the same shape as a bottom wall 43Bf (see FIG. 3A) of the cartridge 4B (see FIG. 3A). The side wall 3B is a part of a side wall which extends upward from a periphery of the bottom wall 3A. The side wall 3B extends upward from a portion in the vicinity of the right side of the front end part of the bottom wall 3A. The attachment part 3 is further provided with a ribbon take-up shaft 31, a tape driving shaft 32, a thermal head 33 and a platen mechanism 34. The ribbon take-up shaft 31 and the tape driving shaft 32 are rotated by a driving force of a tape feeding motor (not shown).

On the side wall 3B, an electrode holder 36 is provided. The electrode holder 36 is movable, with respect to the side wall 3B, in the front-rear direction. The electrode holder 36 is urged rearward by a not-shown urging part (e.g., a spring). When no external force is applied to the electrode holder 36, the electrode holder 36 protrudes rearward from the side wall 3B in accordance with an urging force applied by the urging part. On a rear surface of the electrode holder 36, first electrical contacts 37A and 37B are provided. Each of the first electrical contacts 37A and 37B is a rectangular metallic electrode, and the two first electrical contacts 37A and 37B are arranged in the right-left direction. According to the illustrative embodiment, the shapes of the first electrical contacts 37A and 37B are identical. Further, according to the illustrative embodiment, the first electrical contact 37A is arranged on the left side with respect to the first electrical contact 37B.

<Cartridge Unit>

Figure 3B:
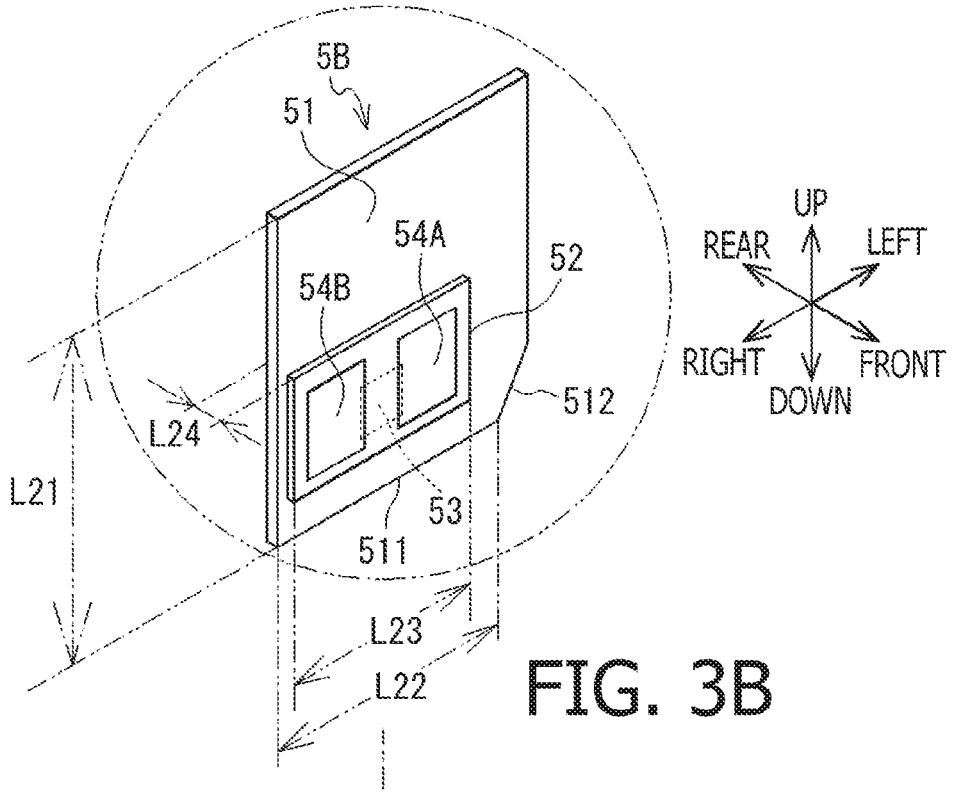
FIG. 3B is an enlarged perspective view of the circuit assembly according to a first embodiment.
Figure 3A:
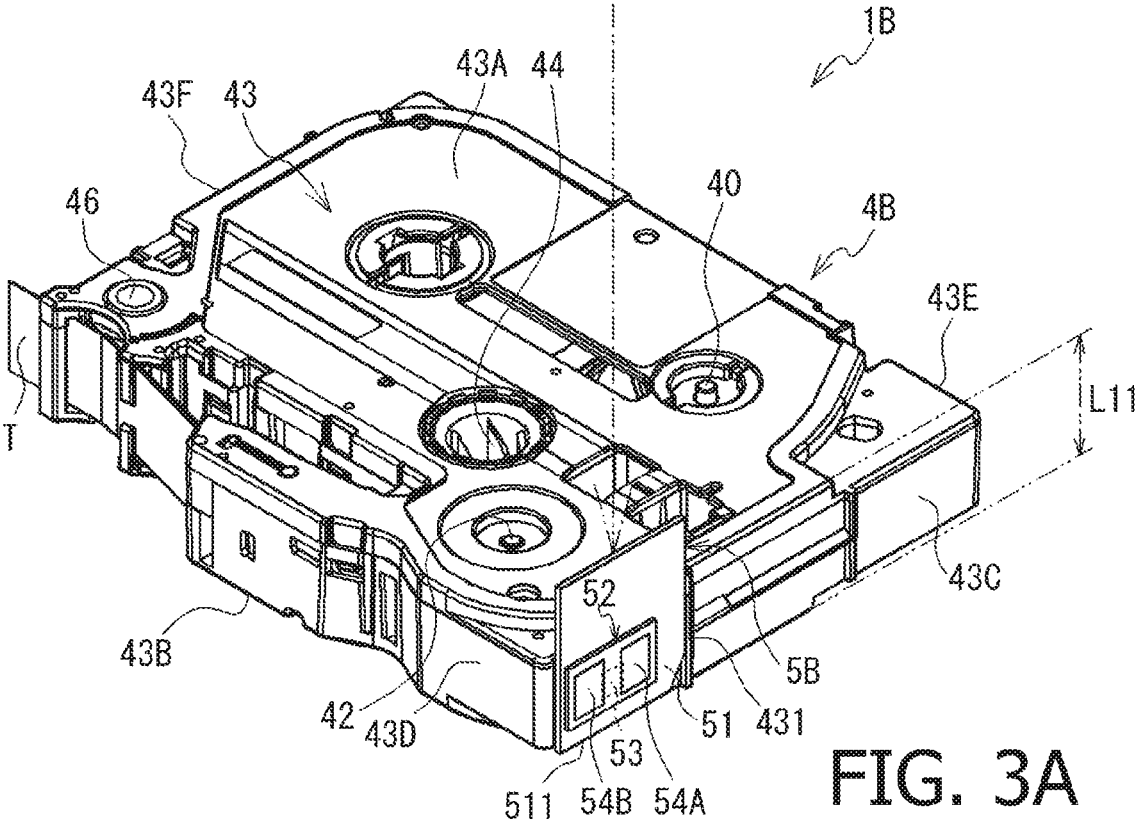
FIG. 3A is a perspective view of a cartridge unit to which a circuit assembly is attached.

As shown in FIG. 3A, the cartridge unit 1B has the cartridge 4B and the circuit assembly 5B. The cartridge 4B accommodates the tape T and an ink ribbon (not shown) which are used when printing is performed by the thermal printer 1A. The circuit assembly 5B retains media information (described later) which can be read by the thermal printer 1A. The cartridge unit 1B is attached to the thermal printer 1A via a first process and a second process which will be described later.

<Cartridge>

The cartridge 4B has a box-like casing 43. The casing 43 has a top wall 43A on the upper side, a bottom wall 43B on the down side, a side wall 43C on the front side, a side wall 43D on the right side, a side wall 43E on the left side and a side wall 43F on the rear side. The opt wall 43 and the bottom wall 43 are parallel to each other. The side walls 43C-43F are arranged to be bridged between the tope wall 43A and the bottom wall 43B. In the following description, a length of the side wall 43C in the up-down direction will be indicated by L11. The side wall 43C has a protruding part 431 at a position on the right side with respect to a central position in the right-left direction. The protruding part 431 protrudes frontward, and extends linearly, in the up-down direction, over the upper end part to the lower end part of the side wall 43C.

A tape spool 40 configured by winding an unprinted tape T is rotatably supported at a left front part inside the casing 43. An ink ribbon spool 42 configured by winding an unused ink ribbon is rotatably supported at a right front part inside the casing 43. A ribbon take-up spool 44 is rotatably supported between the tape spool 40 and the ribbon spool 42 inside the casing 43. The ribbon take-up spool 44 draws out the unused ink ribbon from the ribbon spool 42, and takes up the ink ribbon used for printing. The tape driving roller 46 is rotatably supported at a right rear part inside the casing 43. The tape driving roller 46, in association with a platen roller included in the platen mechanism 40, draws out the unprinted tape T from the tape spool 40.

<Attaching Method (First Process)>

Figure 4A:
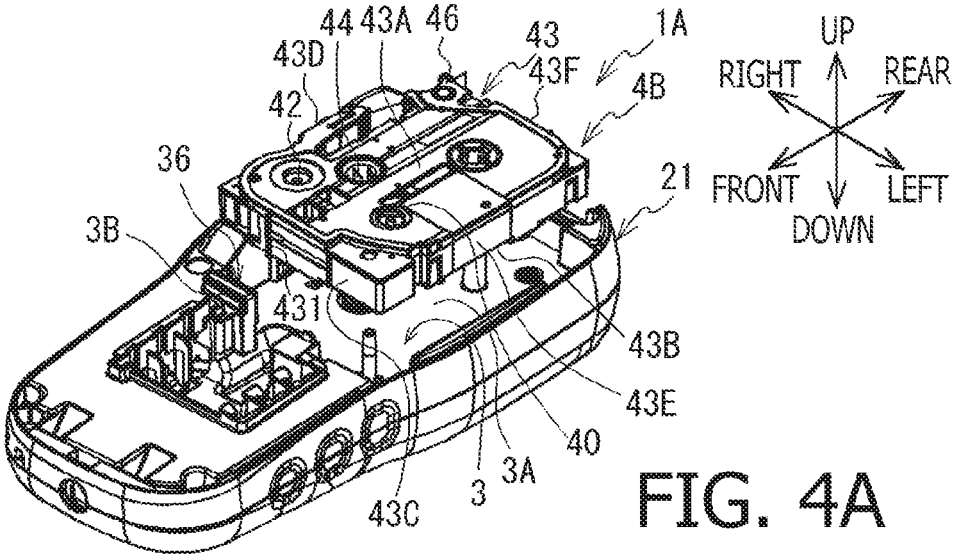
FIGS. 4A-4C show perspective views of the thermal printer illustrating first and second processes.
Figure 4B:
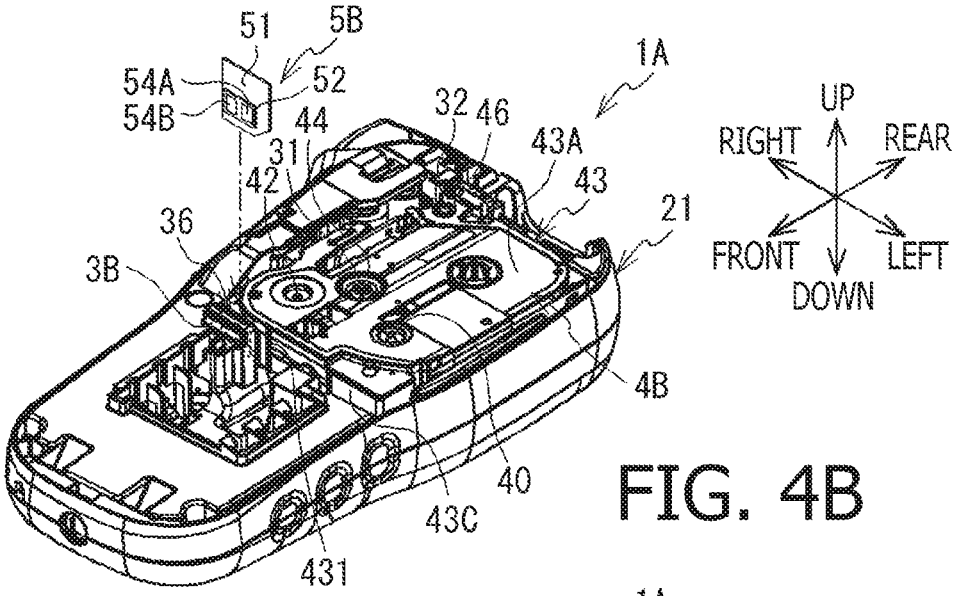

As shown in FIG. 4A, the cartridge 4B is attached to the attachment part 3 from the above with the bottom wall 43B being directed downward and the side wall 43C being directed frontward. In the ribbon take-up spool 44 of the cartridge 4B, the ribbon take-up shaft 31 (see FIG. 2) is inserted. In the tape driving roller 46 of the cartridge 4B, the tape driving shaft 32 (see FIG. 2) is inserted. As shown in FIG. 4B, when the cartridge 4B is attached to the attachment part 3, the bottom wall 3A of the attachment part 3 and the bottom wall 43B of the cartridge 4B face each other in the up-down direction, and the side wall 4B of the attachment part 3 and a right side part of the side wall 43C face each other in the front-rear direction.

In the following description, a state where the cartridge 4B is attached to the attachment part 3 (see FIG. 4B) will be referred to as a "cartridge attached state." In the cartridge attached state, the top wall 43A and the bottom wall 43B of the cartridge 43 are perpendicular to the up-down direction, and the side wall 43C of the cartridge 4B is perpendicular to the front-rear direction. It is noted that the circuit assembly 5B, which will be described in detail later, is attached between the thermal printer 1A and the cartridge 4B in a second process (see FIG. 4C) which will be described later. In FIGS. 4A and 4B, the circuit assembly 5B has not been attached between the thermal printer 1A and the cartridge 4B. Hereinafter, such a state will be referred to as a "circuit assembly unattached state."

As shown in FIG. 4B, in the cartridge attached and the circuit assembly unattached state, in response to the electrode holder 36 being urged toward the side wall 43C of the cartridge 4B, first electrical contacts 37A and 37B (see FIG. 2) of the electrode holder 36 contact the side wall 43C. That is, in the cartridge attached and the circuit assembly unattached state, a distance between each of the first electrodes 37A and 37B and the side wall 43C is zero.

First Embodiment (Circuit Assembly 5B)

As shown in FIGS. 3A and 3B, the circuit assembly 5B has a base member 51 and a circuit substrate 52. The base member 51 has a substantially rectangular shape extending in the up-down direction and in the right-left direction (i.e., the base member 51 is perpendicular to the front-rear direction). The base member 51 is made of synthetic resin such as polyethylene (PE), polypropylene (PP), polystyrene (PS), acrylonitrile butadiene styrene (ABS), polyacetal (POM), polyoxymethylene (POM), polycarbonate (PC), polyethylene terephthalate (PET) or the like. The upper end part and the lower end part of the base member 51 extend in parallel with the right-left direction. The right end part and the left end part of the base member 51 extend in parallel with the up-down direction. A length from the upper end part to the lower end part of the base member 51 in the up-down direction will be indicated by L21. The length L21 of the base member 51 in the up-down direction longer than the length L11 of the side wall 43C of the cartridge 4B in the up-down direction.

At a corner where the left end part and the lower end part of the base member 51 intersect with each other, a cutout 512 is formed. A length, in the right-left direction, of a portion of the base member 51 where the cutout 512 is formed in the up-down direction is smaller at a portion closer to the lower end. A portion of the lower end part of the base member 51 excluding the cutout 512 will be referred to as an extension part 511. The extension part 511 extends in the right-left direction. A length of the extension part 511 in the right-left direction will be indicated by L22.

On the front surface of the base member 51, the circuit substrate 52 is provided. The circuit substrate 52 has a rectangular plate shape extending in the up-down direction and in the right-left direction (i.e., the circuit substrate 52 is perpendicular to the front-rear direction). The circuit substrate 52 is, for example, a print circuit substrate formed of glass epoxy resin (FR4) or the like. A rear surface of the circuit substrate 52 is secured onto the front surface of the base member 51. The upper end part and the lower end part of the circuit substrate 52 extend in parallel with the right-left direction. The right end part and the left end part of the circuit substrate 52 extends in parallel with the up-down direction. A length from the right end part to the left end part of the circuit substrate 52 in the right-left direction will be indicated by L23. The length L22 of the extension part 511 of the base member 51 in the right-left direction is longer than the length L23 of the circuit substrate 52 in the right-left direction. A circuit pattern (not shown) of the circuit substrate 52 is configured to electrically connect the first electrical contacts 37A and 37B with the memory module 53.

A length from the rear surface of the base member 51 to the front surface of the circuit substrate 52 in the front-rear direction will be referred to as a "thickness of the circuit assembly 5B" and indicated by L24. As shown in FIG. 4B, in the cartridge attached and the circuit assembly unattached state, the first electrical contacts 37A and 37B of the electrode holder 36 contact the side wall 43C, and the distance, the front-rear direction, between each of the first electrical contacts 37A and 37B of the electrode holder 36 and the side wall 43C is zero. That is, the thickness L24 of the circuit assembly 5B is larger than the distance, in the front-rear direction, between each of the first electrical contacts 37A and 37B of the electrode holder 36 and the side wall 43C in the cartridge attached and the circuit assembly unattached state.

As shown in FIGS. 3A and 3B, second electrical contacts 54A and 54B are formed on the front surface of the circuit substrate 52. The second electrical contacts 54A and 54B are rectangular metallic electrodes and arranged in the right-left direction. The shapes of the second electrical contacts 54A and 54B are the same, and the shapes of the second electrical contracts 54A and 54B are the same as the shapes of the first electrical contacts 37A and 37B. The second electrical contact 54A is arranged on the left side with respect to the second electrical contact 54B. Each of the second electrical contacts 54A and 54B is exposed frontward.

On the rear surface of the circuit substrate 52, a memory module 53 is provided. The memory module 53 is sandwiched between the base member 51 and the circuit substrate 52. The memory module 53 is a non-volatile storage element such as a flash memory. The memory module 53 stores various pieces of information (hereinafter, referred to as media information) including a type of the cartridge 4B (e.g., a receptor type), a type of the tape T (e.g., a color, a tape width), a remaining amount of the tape T, a type of the ink ribbon, a remaining amount of the ink ribbon and the like.

<Attachment Method (Second Process)>

Figure 4C:
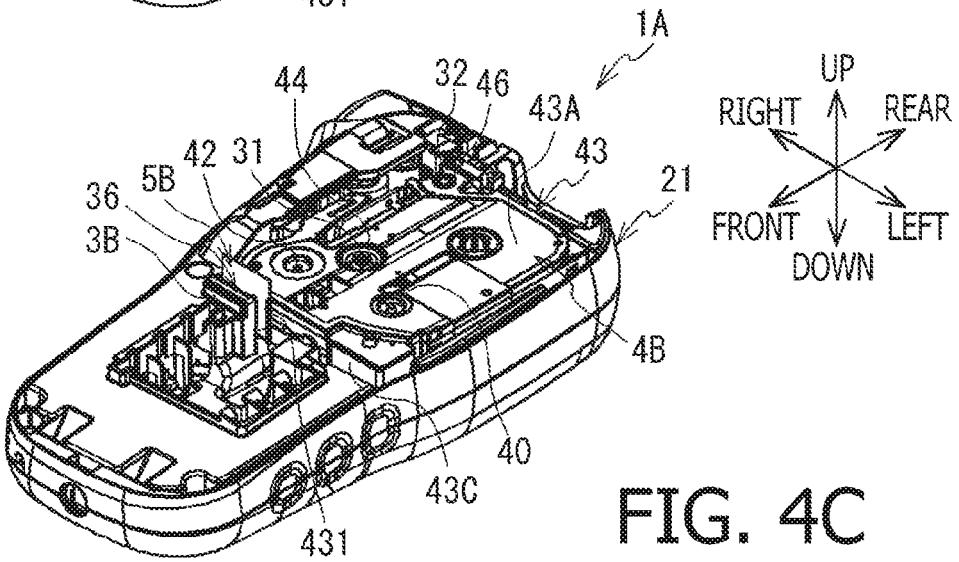

As shown in FIG. 4B, the circuit assembly 5B is oriented such that the extension part 511 (see FIGS. 3A and 3B) is located on the lower side, and the second electrical contacts 54A and 54B are directed frontward. The circuit assembly 5B is attached to the thermal printer 1A, which is in the cartridge attached and the circuit assembly unattached state, from the above. The circuit assembly 5B is inserted, from the above, between the first electrical contacts 37A and 37B (see FIG. 2) provided to the electrode holder 36 of the thermal printer 1A and the side wall 43C of the cartridge 4B. As a result, the circuit assembly 5B is arranged between the first electrical contacts 37A and 37B of the electrode holder 36 (see FIG. 2) and the side wall 43C of the cartridge 4B as shown in FIG. 4C. Hereinafter, a state where the circuit assembly 5B is arranged between the first electrical contacts 37A and 37B and the side wall 43C (see FIG. 4C) will be referred to as a "circuit assembly attached state."

In the cartridge attached and the circuit assembly attached state, the extension part 511 of the base member 51 of the circuit assembly 5B (FIGS. 3A and 3B) contacts the bottom wall 3A (see FIG. 2) of the attachment part 3 of the thermal printer 1A over an entire length of the extension part 511 in the right-left direction. According to the above configuration, the circuit assembly 5B is positioned, in the up-down direction, with respect to the thermal printer 1A. Both the right and left end parts of the base member 51 are in a state of extending in the up-down direction. The left end part of the base member 51 contacts a protruded part 431 provided to the side wall 43C of the cartridge 3B over an entire area thereof in the up-down direction. According to the above configuration, the circuit assembly 5B is positioned in the right-left direction with respect to the cartridge 4B. When the circuit assembly 4B is positioned, with respect to the cartridge 4B, in the up-down direction and in the right-left direction, the second electrical contacts 54A and 54B (see FIG. 4B) of the circuit assembly 5B are arranged in the right-left direction. The first electrical contact 37A (see FIG. 2) of the thermal printer 1A contacts the second electrical contact 54A of the circuit assembly 5B, and the first electrical contact 37B (see FIG. 2) of the thermal printer 1A contacts the second electrical contact 54B of the circuit assembly 54B.

The length L21 in the up-down direction of the base member 51 of the circuit assembly 5B (see FIGS. 3A and 3B) is larger than the length L11 in the up-down direction of the side wall 43C of the cartridge 4B. Therefore, as shown in FIG. 4C, the upper end part of the base member 51 of the circuit assembly 5B protrudes on an upper side with respect to the top wall 43A of the cartridge 4B.

<Printing Process>

In the cassette attached and the circuit assembly attached state (see FIG. 4C), a controller of the thermal printer 1A performs a contact type communication via the first electrical contact 37A (see FIG. 2) and the second electrical contact 54A (see FIGS. 3A and 4B) which contact each other, and via the first electrical contact 37B (see FIG. 2) and the second electrical contact 54B (see FIGS. 3A and 3B) which contact each other. With this communication, the controller of the thermal printer 1A reads the media information stored in the memory module 53 (see FIGS. 3A and 3B) of the circuit assembly 5B.

The controller determines a print condition based on the media information read out from the memory module 53, and displays display information on the display 2B based on the media information. The controller determines a size of character string(s) to be printed, print thickness, a heating temperature of the thermal head 83 and the like as the print condition based on the media information read from the memory module 53. Further, the controller reads the types of the tape T and the ink ribbon, the remaining amounts thereof as the media information from the memory module 53, and displays the same on the display 2B.

When a print start instruction is input through the keyboard 2A (see FIG. 1), the controller drives the ribbon take-up shaft 31 so that the ink ribbon is drawn out from the ribbon spool 42 of the cartridge 4B. Further, the controller drives the tape driving shaft 32 so that the tape T is drawn out from the tape spool 40 of the cartridge 4B. The platen mechanism 34 conveys the ink ribbon and the tape T with urging the same to be press-contacted with the thermal head 33. The controller starts supplying electricity to the thermal head 33 based on the print condition as determined based on the media information. As above, the unused ink ribbon is heated by the thermal head 33, thereby printing onto the tape T being performed.

Effects of First Embodiment (Circuit Assembly 5B)

The circuit assembly 5B of the cartridge unit 1B is arranged between the first electrical contacts 37A, 37B of the electrode holder 36 provided to the side wall 3B of the attachment part 3 of the thermal printer 1A and the side wall 43C of the cartridge 3B in the cartridge attached and the circuit assembly attached state (see FIG. 4C). That is, the circuit assembly 5B is arranged between the side wall 3B of the attachment part 4 of the thermal printer 1A and the side wall 43C of the cartridge 4B, but not between the bottom walls 3A and 43B. Therefore, when the circuit assembly 5B in the circuit assembly attached state is to be detached from the thermal printer 1A, it is unnecessary for the worker to remove the cartridge 4B from the attachment part 4. Therefore, in the circuit assembly attached state, the worker can easily detach the circuit assembly 5B from the thermal printer 1A and exchange the same.

In the thermal printer 1A, the first electrical contacts 37A and 37B contact the side wall 43C in the cartridge attached and the circuit assembly unattached state. In this case, even if a cartridge 4B provided with the second electrical contacts 54A and 54B on the side wall 43C is attached to the attachment part 3 of the thermal printer 1A, the thermal printer 1A can make the first electrical contacts 37A and 37B of the electrode holder 36 contact the second electrical contacts 54A and 54B of the cartridge 4B, respectively. Therefore, according to the thermal printer 1A, when the cartridge 4B having the second electrical contacts 54A and 54B on the side wall 43C is attached to the thermal printer 1A, by performing communication through the first electrical contacts 37A and 37B and the second electrical contacts 54A and 54B, the media information can be obtained.

In the thermal printer 1A, the distance between the first electrical contacts 37A and 37B and the side wall 43C, in the cartridge attached and the circuit assembly unattached state, is zero, which is smaller than the thickness L24 of the circuit assembly 5B. Therefore, when the circuit assembly 5B is set to be in the circuit assembly attached state, the electrode holder 36 urges the first electrical contacts 37A and 37B to the second electrical contacts 54A and 54B in accordance with the urging force received from the urging part. Therefore, the first electrical contacts 37A and 37B can be made contact with the second electrical contacts 54A and 54B, reliably. Accordingly, the thermal printer 1A can perform communication through the first electrical contacts 37A and 37B, and the second electrical contacts 54A and 54B at high precision, and the media information can be obtained reliably.

The user of the thermal printer 1A can perform positioning of the circuit assembly 5B in the up-down direction by making the extension part 511 of the circuit assembly 5B contact the bottom wall 3A of the attachment part 3 in the cartridge attached and the circuit assembly attached state. Therefore the user can easily perform positioning of the circuit assembly 5B in the up-down direction to make the first electrical contacts 37A and 37B contact the second electrical contacts 54A and 54B, reliably.

The length L22 of the extension part 511 of the base member 51 in the right-left direction is longer than the length L23 of the circuit substrate 53 in the right-left direction. According to such a configuration, since the worker make the extension part 511 of the base member 51 contact the bottom wall 3A of the attachment part 3 stably, positioning of the circuit assembly 5B in the up-down direction can be performed easily.

The length L21 of the base member 51 of the circuit assembly 5B in the up-down direction is larger than the length L11 of the side wall 43C of the cartridge 4B in the up-down direction. According to such a configuration, in the cartridge attached and the circuit assembly attached state, the upper end part of the base member 51 of the circuit assembly 5B can be made protrude on the upper side with respect to the top wall 43A of the cartridge 4B. Therefore, since the user can easily pinch the upper end part of the base member 51 of the circuit assembly 5B in the circuit assembly attached state, the user can easily pull out the circuit assembly 5B from the thermal printer 1A.

The cartridge 4B has the protruding part 431 extending in the up-down direction. The user can perform positioning, in the right-left direction, of the circuit assembly 5B with respect to the thermal printer 1A by inserting the circuit assembly 5B between the thermal printer 1A and the cartridge 4B in the cartridge attached state with making the left end part of the base member 51 of the circuit assembly 5B contact the protruding part 431. By performing positioning of the circuit assembly 5B in the right-left direction as described above, the first electrical contacts 37A and 37B can reliably be made contact the second electrical contacts 54A and 54B, respectively.

The circuit assembly 5B has the cutout 512 at the corner where the left end and the lower end of the base member 51 intersect each other. According to such a configuration, the user can bring the circuit assembly 5B to be in the circuit assembly attached state by making the cutout 512 of the base member 51 contact the upper end part of the protruding part 431 of the cartridge 4B, while moving the circuit assembly 5B downward, to guide the circuit assembly 5B rightward. Accordingly, in the cartridge attached state, the user can easily perform an operation of inserting the circuit assembly 5B between the thermal printer 1A and the cartridge 4B.

Second Embodiment (Circuit Assembly 5C)

Figure 5B:
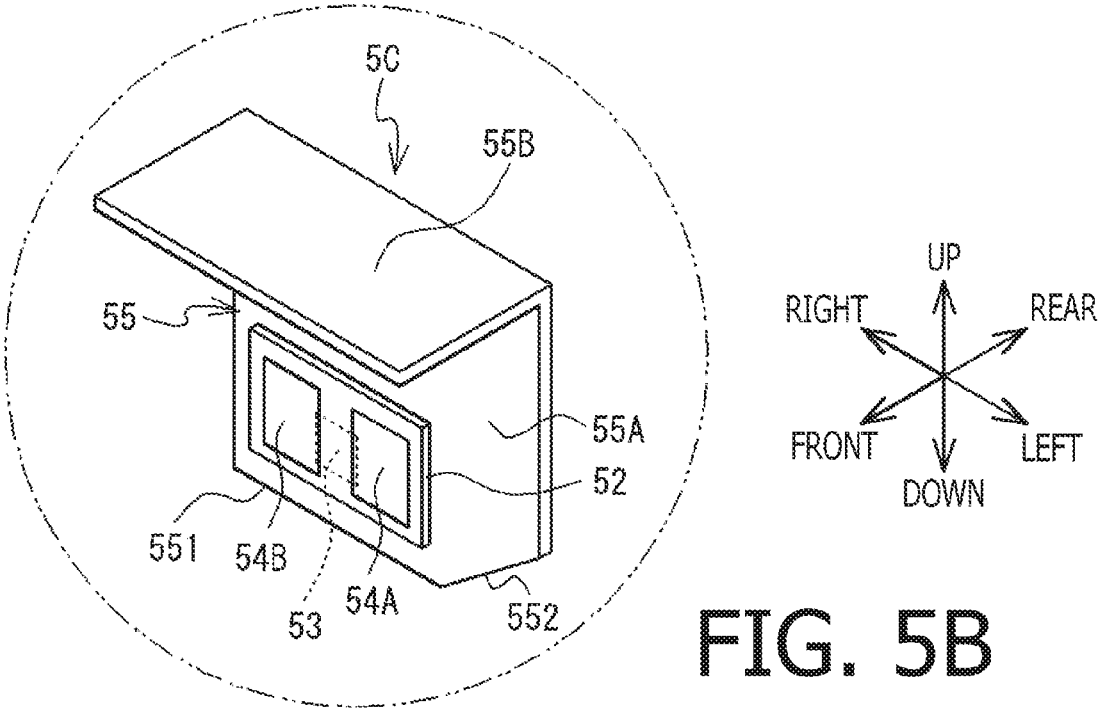
FIG. 5B is a perspective view of another circuit assembly according to a second embodiment.
Figure 5A:
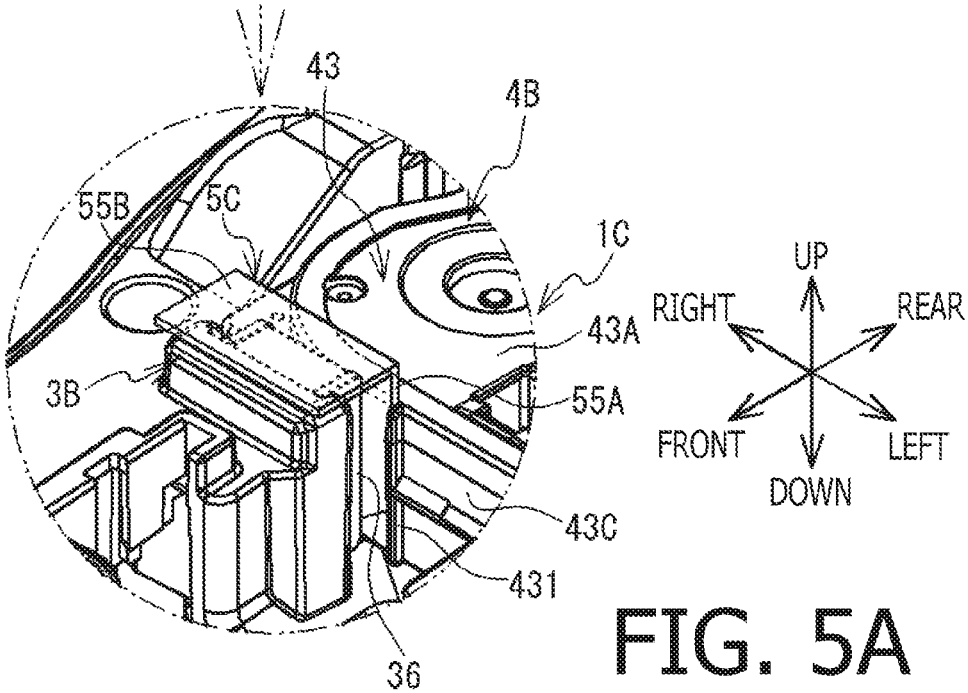
FIG. 5A is a partial perspective view of the thermal printer.

Referring to FIGS. 5A and 5B, a cartridge unit 1C according to a second embodiment will be described. According to the second embodiment, instead of the circuit assembly 5B employed in the first embodiment (see FIG. 3B), a circuit assembly 5C (see FIG. 5B) is employed. The shape of a base member 55 of the circuit assembly 5C is different from the shape of the base member 51 of the circuit assembly 5B (see FIG. 3B). Hereinafter, configurations same as those of the circuit assembly 5B will be assigned with the same reference numbers and description thereof will be omitted.

The circuit assembly 5C according to the second embodiment has the base member 55 and the circuit substrate 52. The base member 55 has a bent plate-like member. The base member 55 has a base part 55A and a first extension part 55B. The base part 55A extends in the up-down direction and in the right-left direction, and is perpendicular to the front-rear direction. An upper end part and a lower end part of the base part 55A extend in parallel with the right-left direction. A right end part and a left end part of the base part 55A extend in parallel with the up-down direction. A length, in the up-down direction, of the base part 55A is substantially the same as the length L11 (see FIG. 3B), in the up-down direction, of the side wall 43C of the cartridge 4B. On a front surface of the base part 55A, the circuit substrate 52 is provided. The second electrical contacts 54A and 54B provided to the front surface of the circuit substrate 52 are arranged in the right-left direction. At a corner where the left end part and the lower end part of the base part 55A intersect, a cutout 552 is formed. The lower end part of the based member 55 except the cutout 552 corresponds to an extension part 551 described above. The first extension part 55B extends frontward, in a direction perpendicular to the base part 55A, from the upper end part of the base part 55A. The first extension part 55B is perpendicular to the up-down direction.

When in the cartridge attached and in the circuit assembly attached state, the first extension part 55B of the circuit assembly 5C contacts the electrode holder 36 from the above. The first extension part 55B is arranged above the first electrical contacts 37A and 37B of the electrode holder 36 and the second electrical contacts 54A and 54B of the circuit substrate 52, and a lower surface of the first extension part 55B faces the first electrical contacts 37A and 37B of the electrode holder 36 and the second electrical contacts 54A and 54B of the circuit substrate 52. Further, the left end part of the base part 55A contacts the protruding part 431 provided to the side wall 43C of the cartridge 4B. According to the above configuration, the circuit assembly 5C is positioned in the up-down direction and the right-left direction with respect to the cartridge 4B. By the positioning of the circuit assembly 5C with respect to the cartridge 4B, the first electrical contacts 37A of the thermal printer 1A (see FIG. 2) contacts the second electrical contacts 54A of the circuit assembly 5C, and the first electrical contacts 37B of the thermal printer 1A (see FIG. 2) second electrical contact 54B of the circuit assembly 5C.

Effects of Second Embodiment

The user can perform positioning, in the up-down direction, of the circuit assembly 5C by making the first extension part 55B contact the upper end part of the electrode holder 36 of the thermal printer 1A in the second process. Therefore, the positioning of the circuit assembly 5C in the up-down direction in the second process can be performed appropriately, thereby making the first electrical contacts 37A and 37B of the thermal printer 1A contact the second electrical contacts 54A and 54B of the circuit assembly 5C. Further, the circuit assembly 5C is configured such that, if the circuit assembly 5C is placed on a placing surface with the second electrical contacts 54A and 54B facing downward, the first extension part 55B suppresses the second electrical contacts 54A and 54B from directly contacting the placing surface. Thus, according to the circuit assembly 5C, by the first extension part 55B, the second electrical contacts 54A and 54B are suppressed from being smeared or corroded.

In the cartridge attached state and the circuit assembly attached state, the extension part 551 of the base part 55A of the circuit assembly 5C may contact the bottom wall 3A (see FIG. 2) of the attachment part 4 of the thermal printer 1A. In such a case, the first extension part 55B of the circuit assembly 5C is spaced upwardly with respect to the electrode holder 36. Thus, since the user can easily pinch the first extension part 55B of the circuit assembly 5C in the circuit assembly attached state, the user can easily pull out the circuit assembly 5C from the thermal printer 1A.

Third Embodiment (Circuit Assembly 5D)

Figure 6B:
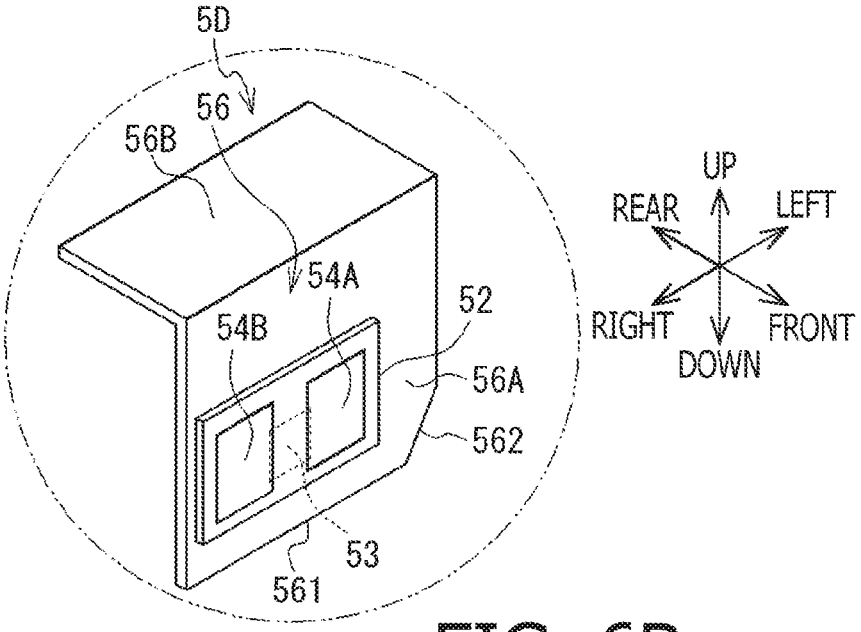
FIG. 6B is an enlarged perspective view of the circuit assembly according to a third embodiment.
Figure 6A:
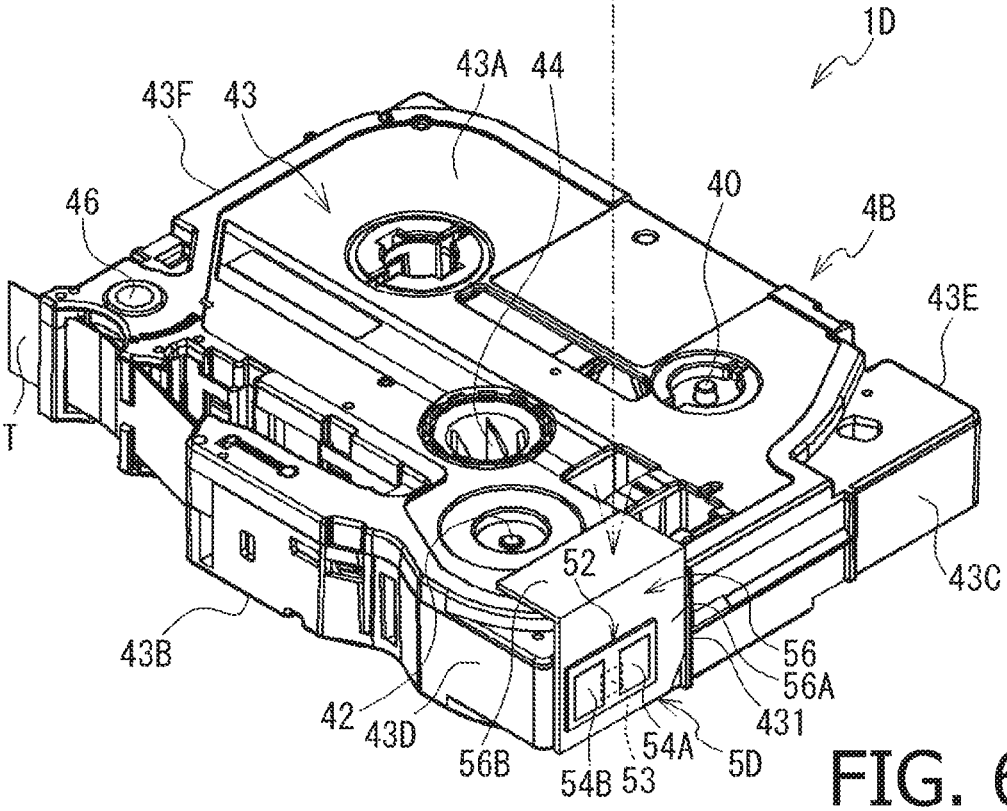
FIG. 6A is a perspective view of a cartridge unit to which a circuit assembly is attached.

Referring to FIGS. 6A and 6B, a cartridge unit 1D according to a third embodiment will be described. According to the second embodiment, instead of the circuit assembly 5B employed in the first embodiment (see FIG. 3B), a circuit assembly 5D (see FIG. 6B) is employed. A direction in which a first extension part 56B of a base member 56 of the circuit assembly 5D extends is different from the direction of the first extension part 55B (see FIG. 5B) of the circuit assembly 5C extends. Hereinafter, configurations same as those of the circuit assembly 5B or 5C will be assigned with the same reference numbers and description thereof will be omitted.

The circuit assembly 5D has the base member 56 and the circuit substrate 52. The base member 56 has a base part 56A and the first extension part 56B. The base part 56A corresponds to the base part 55A of the base member 55 according to the second embodiment (see FIGS. 5A and 5B). The circuit substrate 52 is provided to the front surface of the base part 56A. A cutout 562 corresponds to the cutout 552 of the second embodiment (see FIGS. 5A and 5B). An extension part 561 corresponds to the extension part 551 of the second embodiment (see FIGS. 5A and 5B). The first extension part 56B extends rearward from the upper end part of the base part 56A, in a direction perpendicular to the base part 56A. The first extension part 56B is perpendicular to the up-down direction. In the cartridge attached and the circuit assembly attached state, the first extension part 56B of the circuit assembly 5D faces the top wall 43A of the cartridge 4B from the above. The first extension part 56B contacts the top wall 43A from the above, and extends long the top wall 43A.

Effects of Third Embodiment

The user can perform positioning of the circuit assembly 5D in the up-down direction by making the first extension part 57B contact with the top wall 43A of the cartridge 4B in the second process. Therefore, positioning, in the up-down direction, of the circuit assembly 5D in the second process can be performed further reliably, and the second electrical contacts 54A and 54B of the circuit assembly 5D are made contact with the first electrical contacts 37A and 37B of the thermal printer 1A, reliably. Further, it becomes possible that a contacting area between the top wall 43A of the cartridge 4B and the first extension part 56B is larger than a contacting area between the first extension part 55B and the electrode holder 36 in the second embodiment. Therefore, a condition of the circuit assembly 5D in the circuit assembly attached state is stabilized, and displacement of the circuit assembly 5D can be effectively suppressed.

Fourth Embodiment (Circuit Assembly 5E)

Figure 7B:
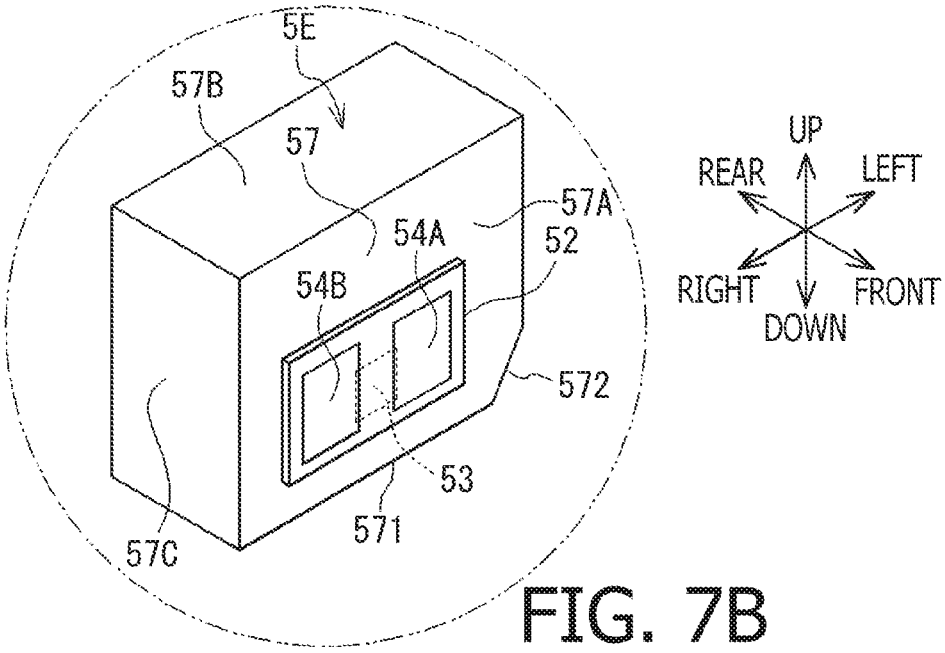
FIG. 7B is an enlarged perspective view of the circuit assembly according to a fourth embodiment.
Figure 7A:
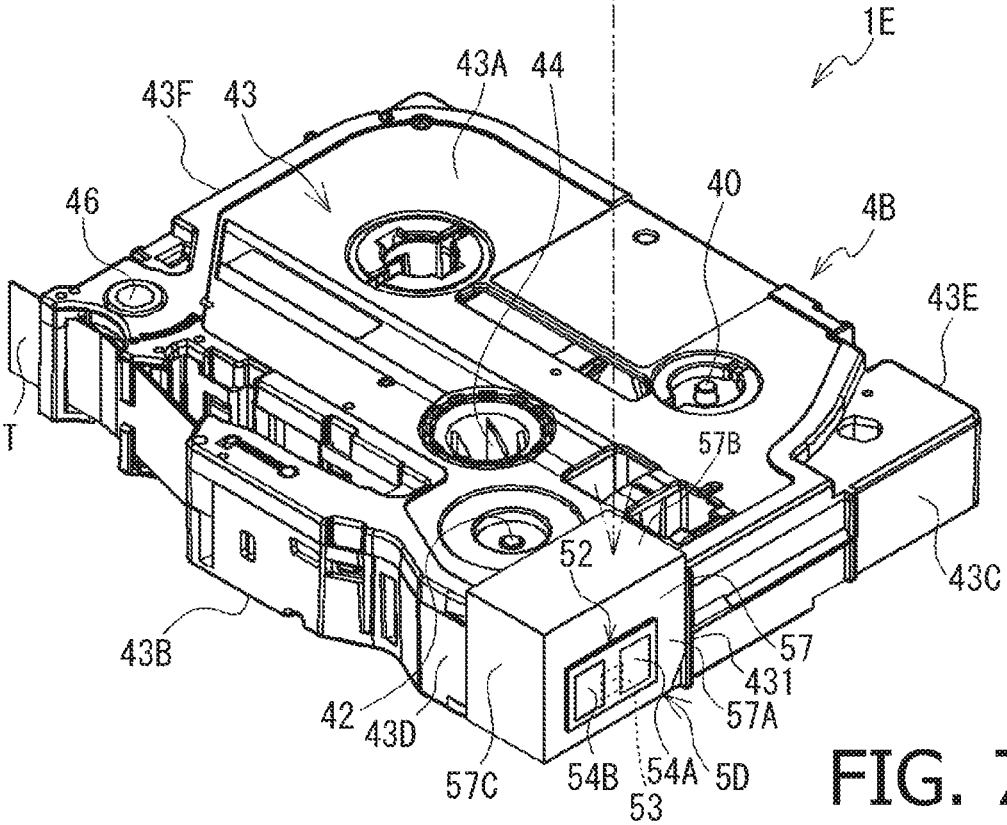
FIG. 7A is a perspective view of a cartridge unit to which a circuit assembly is attached.

Referring to FIGS. 7A and 7B, a cartridge unit 1E according to a fourth embodiment will be described. According to the fourth embodiment, instead of the circuit assembly 5B (see FIG. 3B) according to the first embodiment, a circuit assembly 5E is used. The circuit assembly 5E is different from the circuit assembly 5D according to the third embodiment in that a second extension part 57C is provided in addition to a first extension part 57B. Hereinafter, configurations same as those in the circuit assembly 5B or 5D, the same reference numbers area assigned and description thereof will be omitted.

The circuit assembly 5E has a base member 57 and the circuit substrate 52. The base member 57 has a base part 57A, the first extension part 57B and the second extension part 57C. The base part 57A corresponds to the base part 56A of the base member 56 of the third embodiment (see FIGS. 6A and 6B). The first extension part 57B corresponds to the first extension part 56B of the third embodiment (see FIGS. 6A and 6B). A cutout 572 corresponds to the cutout 562 of the third embodiment (see FIGS. 6A and 6B). An extension part 571 corresponds to the extension part 562 of the third embodiment (see FIGS. 6A and 6B). The second extension part 57C extends rearward from the right end part of the base part 57A, in a direction perpendicular to the base part 57A. The second extension part 57C is perpendicular to the right-left direction.

In the cartridge attached state and the circuit assembly attached state, the first extension part 57B of the circuit assembly 5E faces the top wall 43A of the cartridge 4B from the above. The second extension part 57C faces the side wall 43D of the cartridge 4B from the right side thereof. The second extension part 57C contacts the side wall 43D from the right side and extends along the side wall 43D.

Effects of Fourth Embodiment

The user can perform positioning of the circuit assembly 5E in the up-down direction and the right-left direction by making the first extension part 57B contact the top wall 43A of the cartridge 4B and making the second extension part 57C contact the side wall 43D of the cartridge 4B in the second process. Therefore, positioning of the circuit assembly 5E in the up-down direction and the right-left direction in the second process can be appropriately preformed, and it becomes possible to make the second electrical contacts 54A and 54B of the circuit assembly 5E contact the first electrical contacts 37A and 37B of the thermal printer 1A.

Fifth Embodiment (Circuit Assembly 5F and Cartridge 4C)

Figure 8B:
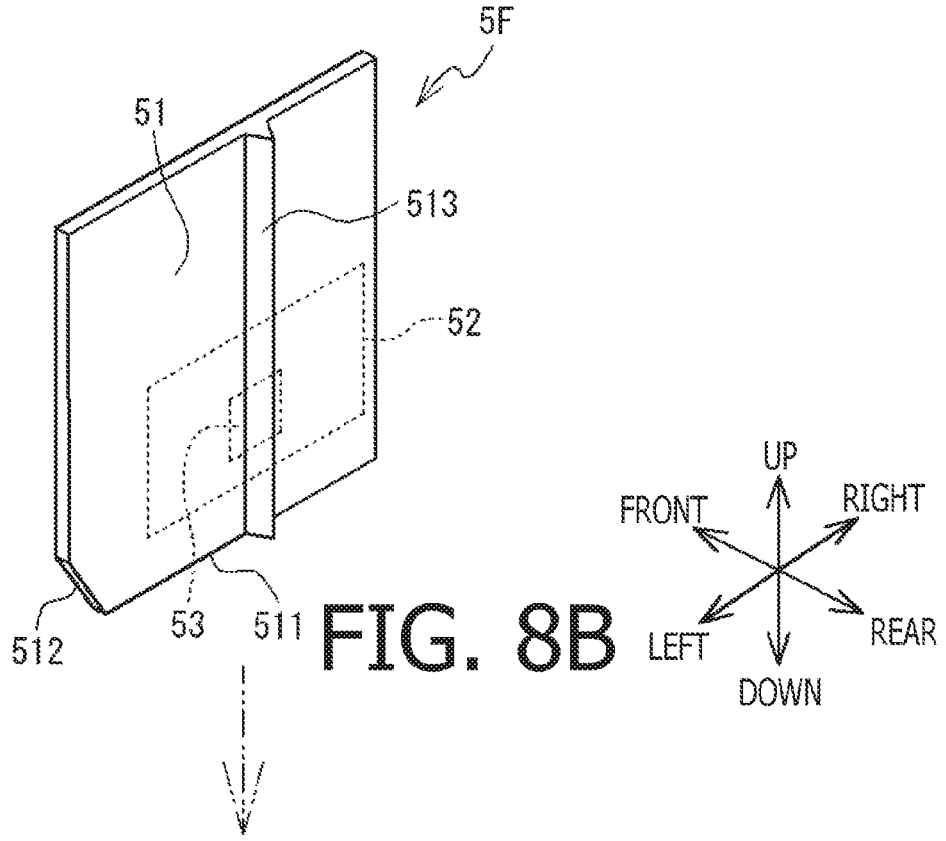
FIG. 8B is a perspective view of another circuit assembly according to a fifth embodiment.
Figure 8A:
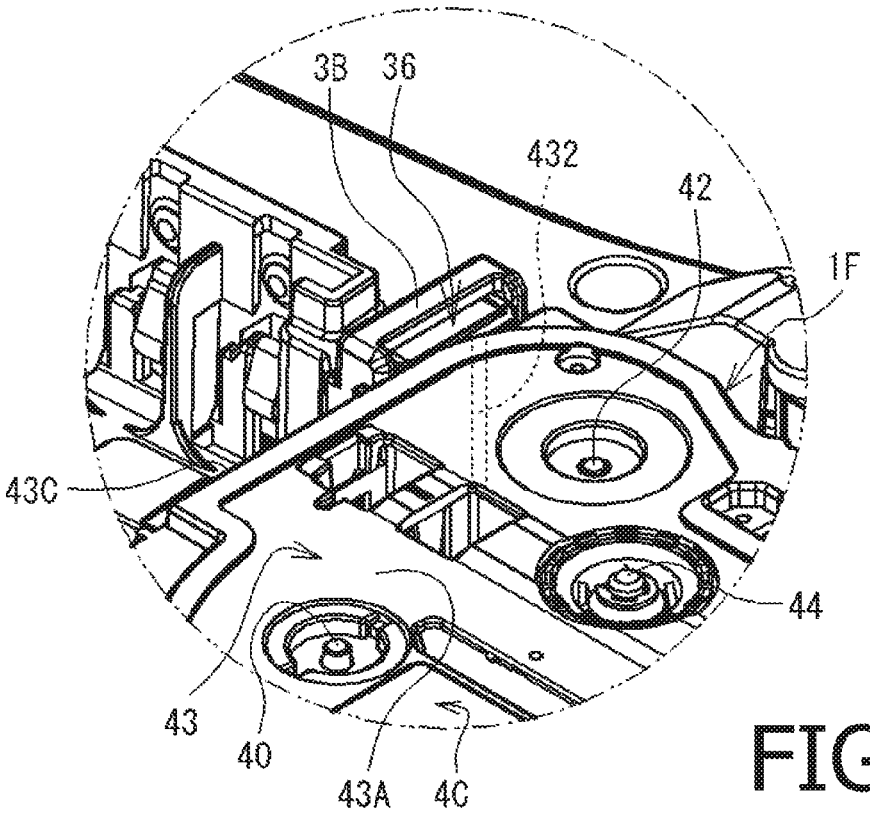
FIG. 8A is a partial perspective view of the thermal printer.

Referring to FIGS. 8A and 8B, a cartridge unit 1F according to a fifth embodiment will be described. According to the fifth embodiment, instead of the circuit assembly 5B and the cartridge 4B (see FIGS. 3A and 3B) according to the first embodiment, a circuit assembly 5F and a cartridge 4C are used. The circuit assembly 5F is different from the circuit assembly 5B in that a first engaging part 513 is provided. The cartridge 4C is different from the cartridge 4B in that a second engaging part 432 with which the first engaging part 513 can engage is provided. Hereinafter, configurations same as those in the circuit assembly 5B and the cartridge 4B, the same reference numbers area assigned and description thereof will be omitted.

The circuit assembly 5F is configured such that the first engaging part 513 is provided onto the rear surface of the base member 51. The first engaging part 513 is a protrusion which protrudes rearward and linearly extends, in the up-down direction, from the upper end part to the lower end part of the base member 51. The cartridge 4C has a second engaging part 432. The second engaging part 432 is a recessed part (e.g., a groove) and linearly extends, in the up-down direction, from the upper end to the lower end of the side wall 43C.

In the second process, the circuit assembly 5F is inserted into a space between the first electrical contacts 37A and 37B provided to the electrode holder 36 of the thermal printer 1A and the side wall 43C of the cartridge 4C from the above. At this stage, the first engaging part 513 of the circuit assembly 5F is inserted into the second engaging part 432 of the cartridge 4C from the above. Then, as the extension part 511 of the base member 51 contacts the bottom wall 3A (see FIG. 2) of the attachment part 4 of the thermal printer 1A, positioning of the circuit assembly 5F in the up-down direction with respect to the thermal printer 1A is performed. In the cartridge attached state and the circuit assembly attached state, the first engaging part 513 and the second engaging part 432 engage with each other over an entire length in the up-down direction. In this state, the second electrical contacts 54A and 54B of the circuit assembly 5F contact the first electrical contacts 37A and 37B of the thermal printer 1A, respectively.

Effects of Fifth Embodiment

When the circuit assembly 5F is in the circuit assembly attached state, as the first engaging part 513 engages with the second engaging part 432, relative movement, in the right-left direction, of the circuit assembly 5F with respect to the cartridge 4C is prevented. That is, in a state where the first engaging part 513 and the second engaging part 432 engage with each other, the first engaging part 513 and the second engaging part 432 can maintain a state where the circuit assembly 5F is positioned in the right-left direction with respect to the cartridge 4C. Thus, according to the circuit assembly 5F, a state where the first electrical contacts 37A and 37B contact the second electrical contacts 54A and 54B is maintained, while displacement of the circuit assembly 5F is reliably suppressed.

Sixth Embodiment (Circuit Assembly 5G)

Figure 9A:
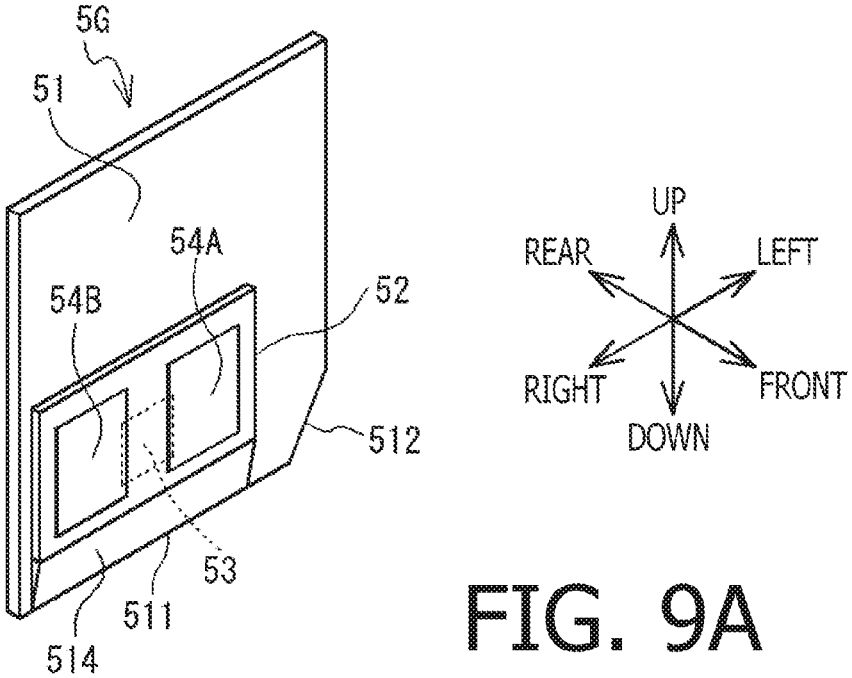
FIG. 9A is a perspective view of another circuit assembly according to a sixth embodiment.
Figure 9B:
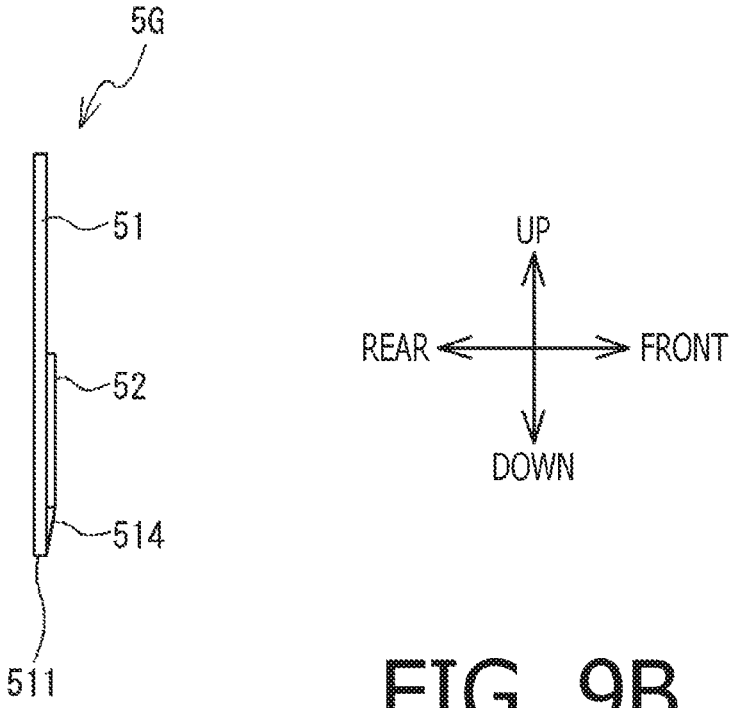
FIG. 9B is a side view of the circuit assembly shown in FIG. 9A.

Referring to FIGS. 9A and 9B, a circuit assembly 5G according to a sixth embodiment will be described. The circuit assembly 5G is different from the circuit assembly 5B according to the first embodiment (see FIGS. 3A and 3B) in that the circuit assembly 5G has a tapered part 514. The tapered part is formed on a lower side of the front surface of the base member 51 relative to the circuit substrate 52 and the second electrical contacts 54A and 54B. As shown in FIG. 9A, the tapered part 514 is a substantially plate-like part having a rear surface perpendicular to the front-rear direction, and a front surface inclined with respect to the rear surface. As shown in FIG. 9B, the thickness of an upper portion of the tapered part 514 is substantially the same as the thickness of the circuit substrate 52, and the thickness of the tapered part 514 smaller in the lower portion than in the upper portion of the tapered part 514.

Effects of Sixth Embodiment

When the circuit assembly 5G is attached in the second process, the circuit assembly 5G is inserted between the first electrical contacts 37A, 37B and the side wall 43C, which are in a contact state, from the above. The tapered part 514 is inserted downward with increasing an interval between the first electrical contacts 37A, 37B and the side wall 43C by pushing the electrode holder 36 frontward against the urging force by an urging member. As the circuit assembly 5G is further inserted downward and the extension part 511 contacts the bottom wall 4A of the attachment part 4, the circuit assembly 5G is arranged between the first electrical contacts 37A, 37B of the electrode holder 36 (see FIG. 2) and the side wall 43C of the cartridge 4B. In such a state, the second electrical contacts 54A, 54B contact the first electrical contacts 37A, 37B, respectively. As described above, since the tapered part 514 can broaden an interval between the first electrical contacts 37A, 37B and the side wall 43C in the second process, an operation to attach the circuit assembly 5G can be facilitated.

Seventh Embodiment (Circuit Assembly 5H)

Referring to FIGS. 10A and 10B, a circuit assembly 5H according to a seventh embodiment will be described. The circuit assembly 5H has a base member 61 and a circuit substrate 62. The base member 61 is arranged to be perpendicular to the front-rear direction. At a corner where the left end part and the lower end part of the base member 51 intersect, a cutout 612 is formed. The lower end of the base member 61 except for the cutout 612 will be referred to as an extension part 611. On the rear surface of the base member 61, a recess 61C recessed frontward is formed. On a bottom surface 61D of the recess 61C, a through hole 61A penetrating through the bottom surface 61D in the front-rear direction is formed. Another though hole 61B which also penetrates through the bottom surface 61D in the front-rear direction is formed at a position shifted rightward with respect to the through hole 61A. The circuit substrate 62 is provided to the bottom surface 61D of the recess 61C. The front surface of the circuit substrate 62 is fixed to the bottom surface 61D.

On the front surface of the circuit substrate 62, second electrical contacts 64A and 64B are provided. The second electrical contacts 64A and 64B are arranged in the right-left direction. The shapes of the second electrical contacts 64A and 64B are identical, and the same as the shape of the first electrical contacts 37A and 37B. The second electrical contact 64A is arranged on the left side with respect to the second electrical contact 64B. The second electrical contact 64A is exposed frontward (i.e., viewable from the front side) through the through hole 61A, while the second electrical contact 64B is exposed frontward (i.e., viewable from the front side) through the through hole 61B. On the rear surface of the circuit substrate 62, a memory module 63 is provided. In the memory module 63, media information is stored.

A position P2 of the front end part of the memory module 63 is closer, in the front-rear direction, to a position P1 of the front surface of the circuit substrate 62 than a position P3 of the rear end part of the memory module 63. Hereinafter, a distance between the position P1 of the front surface of the circuit substrate 62 and the position P3 of the rear end part of the memory module 63 in the front-rear direction will be indicated by L31. Further, a distance, in the front-rear direction, between the position P1 of the front surface of the circuit substrate 62 and a position P4 of the rear end part of the base member 61 will be indicated by L32. In this case, the distance L31 is smaller than the distance L32.

It should be noted that, depending on the shapes of the base member 61, the circuit substrate 62 and the memory module 63, a maximum value of the distance L31 and a maximum value of the distance L32 should be referred to (i.e., the maximum value of the distance L31 is smaller than the maximum value of the distance L32).

Effects of Seventh Embodiment

In a state where the memory module 63 protrudes rearward with respect to the base member 61, when the circuit assembly 5H is inserted between the first electrical contacts 37A, 37B and the side wall 43C (in the second process), there could be a case where the memory module 63 is caught by the cartridge 4B. Such a situation is not preferable since the second process cannot be performed smoothly. Further, as the memory module 63 is caught by the cartridge 4B, the memory module 63 may be damaged. According to the circuit assembly 5H, since L31 is smaller than L32, the memory module 63 is located on the front side with respect to the position P4 of the rear end part of the base member 61, and does not protrude rearward. Therefore, according to the circuit assembly 5H, the memory module 63 is suppressed from being caught by the cartridge 4B in the second process. Thus, according to the seventh embodiment, the user can perform the second process smoothly. Further, the memory module 63 is suppressed from being damaged.

Eighth Embodiment (Circuit Assembly 5I)

Referring to FIGS. 11A and 11B, a circuit assembly 5I according to an eighth embodiment will be described. The circuit assembly 5I has a base member 65 and a circuit substrate 62. The base member 65 has a bent plate shape. As shown in FIG. 11B, the base member 65 has a first base part 651, a second base part 652 and a third base part 653. The first base part 651 is perpendicular to the front-rear direction. The second base part 652 extends obliquely upward from the lower end part of the first base part 651. The third base part 653 extends upward from the rear end part of the second base part 652. The third base part 653 is perpendicular to the front-rear direction. On a rear surface of the first base part 651, the circuit substrate 62 is provided. The front surface of the circuit substrate 65 is fixed to the rear surface of the first base part 651. On the front surface of the circuit substrate 62, the second electrical contacts 64A and 64B are provided. The second electrical contact 64A is exposed frontward through a through hole 65A formed on the first base part 651 of the base member 65. The second electrical contact 64B is exposed frontward through a through hole 65B formed on the first base part 651. On the rear surface of the circuit substrate 62, the memory module 63 is provided.

Effects of Eighth Embodiment

When the circuit assembly 5I is inserted between the electrode holder 36 and the side wall 43C in the second process, a force causing the first base part 651 and the third base part 653 to approach acts from the electrode holder 36 and the side wall 43C to the base member 65. With this force, the second base part 652 of the base member 65 is elastically deformed, thereby the first base part 651 and the third base part 653 approaching each other. In this case, in accordance with a restoring force of the second base part 652, a force directed frontward acts on the first base part 651. The second electrical contacts 64A and 64B are urged to contact the first electrical contacts 37A and 37B from the rear side. Therefore, according to the circuit assembly 5I, the second electrical contacts 64A and 64B can be appropriately contacted wo the first electrical contacts 37A and 37B.

The memory module 63 of the circuit substrate 62 is covered with the third base part 653 of the base member 65 from the rear side. Accordingly, when an impact is applied from the third base part 653 side when, for example, the circuit assembly 5I falls down, the third base part 653 can suppress transmission of the impact to the memory module 63. Therefore, the circuit assembly 5I can suppress the memory module 63 being damaged by the impact.

<Modifications>

Aspects of the present disclosures need not be limited to the above-described embodiments, but can be modified in various ways. In the following description, modifications will be described based on the cartridge unit 1B (i.e., the cartridge 4B and the circuit assembly 5B) according to the first embodiment. However, the modifications could be applied to any of second through eight embodiments as well.

When in the cartridge attached and the circuit assembly unattached state, the first electrical contacts 37A and 37B may not contact the side wall 43C, but may be separated therefrom. By designing a distance between the first electrical contacts 37A, 37B and the side wall 43C in the cartridge attached and the circuit assembly unattached state smaller than the thickness L24 of the circuit assembly 5B, it becomes possible that the first electrical contacts 37A, 37B appropriately contact the second electrical contacts 54A, 54B, respectively, when the circuit assembly 5B is in the circuit assembly attached state.

It is noted that a length L21, in the up-down direction, of the base member 51 of the circuit assembly 5B may be designed to be the same as a length L11, in the up-down direction, of the side wall 43C of the cartridge 4B. Alternatively, the length L21 may be designed to be longer than the length L11. In this case, in the circuit assembly attached state, the first extension part 55B of the circuit assembly 5C may be separated upwardly from the electrode holder 36. Further, the length L21 may be designed to be smaller than the length L11. Further alternatively, a length, in the up-down direction, of the base part 55A of the base member 55 of the circuit assembly 5C may be designed to be smaller than the length L11, in the up-down direction, of the side wall 43C of the cartridge 4B.

It is noted that a portion of the bottom wall 3A, which portion contacts the extension part 511 of the circuit assembly 5B, of the attachment part 4 of the thermal printer 1A, may be formed with convex and concave parts. In such a case, on a corresponding portion of the extension part 511 of the circuit assembly 5B, corresponding concave and convex parts may be formed so as to closely contact the convex and concave parts on the bottom wall 3A. It is also noted that a label indicating media information may be adhered to the circuit assembly 5B.

The length L23 of the circuit substrate 52 of the circuit assembly 5B in the right-left direction may be substantially the same as the length L22 of the extension part 511 of the base member 51 in the right-left direction, or the length L23 of the circuit substrate 52 in the right-left direction is longer than the length L22 of the extension part 511 in the right-left direction.

It is noted that the lower end part of the circuit assembly 5B may be formed to have a step, or a level difference. By the level differences, a plurality of portions extending in the right-left directions may be formed at the lower end part of the circuit assembly 5B. In such a case, among the plurality of portions formed at the lower end part of the circuit assembly 5B, the lowermost portion corresponds to the extension part 511 which contacts the bottom wall 3A of the attachment part 3 in the circuit assembly attached state.

Figures 12A, 12B:
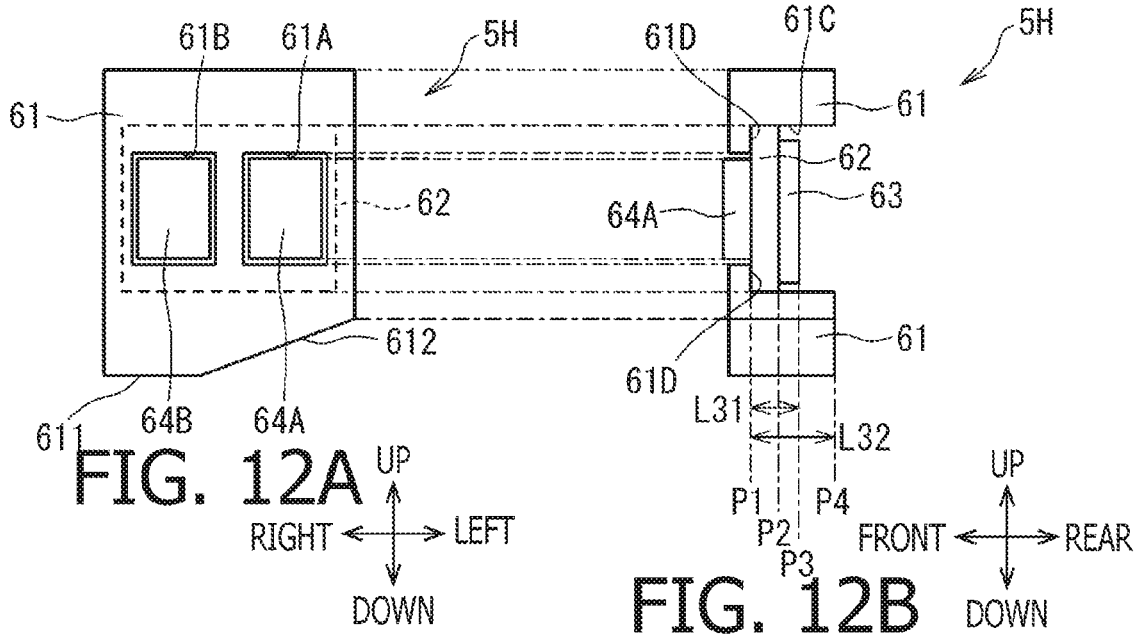
FIG. 12A is a front view of a circuit assembly according to a modified embodiment.
FIG. 12B is a side view of the circuit assembly according to the modified embodiment.

As shown in FIGS. 12A and 12B, a circuit assembly 5H may be configured that the extension part 611 may be formed on the right side with respect to the center, in the right-left direction, of the lower end part of the base member 61. That is, the extension part 611 may not be provided on the left side with respect to the center, in the right-left direction, of the lower end part of the base member 61. In contrast, the extension part 611 may be provided on the left side with respect to the center, in the right-left direction, of the lower end part of the base member 61. That is, the extension part 611 may not be provided on the right side with respect to the center, in the right-left direction, of the lower end part of the base member 61.

In the second process, the extension part 611 of the base member 61 contacts the electrode holder 36 to move the same rearward, thereby forming a clearance between the first electrical contacts 37A, 37B and the side wall 43. Thus, it becomes possible that the circuit assembly 5H is inserted between the first electrical contacts 37A, 37B and the side wall 43C. If the extension part 611 is formed on the right side, or the left side with respect to the center, in the right-left direction, of the lower end part of the base member 61 as described above, working points of the force applied from the base member 61 to the electrode holder 36 concentrate, the electrode holder 36 can move rearward easily. Therefore, the clearance between the first electrical contacts 37A, 37B and the side wall 43C can be formed easily, and accordingly, the circuit assembly 5H can easily be inserted between the first electrical contacts 37A, 37B and the side wall 43C. Therefore, the user can easily set the circuit assembly 5H to the circuit assembly attached state. The above-described configuration is preferable since the circuit assembly attached state can easily be realized even if the width, in the front-rear direction, of the base member 61 is larger as in the circuit assembly 5H than another circuit assembly.

In the second embodiment, when the length, in the up-down direction, of the base part 55A of the base member 55 of the circuit assembly 5C is the same as the length L11, in the up-down direction, of the side wall 43C of the cartridge 4B, the user can easily pinch the first extension part 55B in the circuit assembly attached state. Therefore, the user can easily pull out the circuit assembly 5C from the thermal printer 1A.

Similarly, in the third embodiment, when the length, in the up-down direction, of the base part 56A of the base member 56 of the circuit assembly 5D is the same as the length L11, in the up-down direction, of the side wall 43C of the cartridge 4B, the user can easily pinch the first extension part 56B in the circuit assembly attached state. Therefore, the user can easily pull out the circuit assembly 5D from the thermal printer 1A.

It is noted that the protruding part 431 may not be provided to the side wall 43C of the cartridge 4B. Further, the cutout 512 may not be formed on the circuit assembly 5B. The circuit assembly 5B may include both the first extension part (see FIG. 5) extending frontward from the upper end part, and the first extension part (see FIG. 6) extending rearward from the upper end part. In this case, the two first extension parts may be arranged along a common virtual plane.

In the fourth embodiment, the circuit assembly 5E may have only the second extension part 57C extending rearward from the base part 57A, and may not have the first extension part 57B.

In the fifth embodiment, the first engaging part 513 may be a recessed part (e.g., a groove) formed on the rear surface of the base member 51. In such a case, the second engaging part 432 may be a protrusion protruding frontward from the side wall 43C of the cartridge 4C.

In the fifth embodiment, a plurality of first engaging parts 513 may be provided to the base member 51. Similarly, a plurality of second engaging parts 432 may be provided to the side wall 43C of the cartridge 4C.

The bottom wall 3A is an example of a printer bottom wall according to aspects of the present disclosures. The bottom wall 43B is an example of a cartridge bottom wall according to aspects of the present disclosures. The top wall 43A is an example of a cartridge top wall according to aspects of the present disclosures. The side walls 43C-43F are examples of a cartridge side wall according to aspects of the present disclosures. The side wall 43C is an example of a particular cartridge side wall according to aspects of the present disclosures. The up-down direction is an example of a first direction according to aspects of the present disclosures. The lower side, or the down side is an example of a one side of the first direction according to aspects of the present disclosures. The upper side is an example of the other side of the first direction according to aspects of the present disclosures. The right-left direction is an example of a second direction according to aspects of the present disclosures. The left side is an example of a one side of the second direction according to aspects of the present disclosures. The right side is an example of the other side of the second direction according to aspects of the present disclosures. The front surface of the base member 51 is an example of a one-side surface of the base member according to aspects of the present disclosures. The rear surface of the base member 51 is an example of the other surface of the base member according to aspects of the present disclosures. The front surface of the circuit substrate 52 is an example of a one side surface of the circuit substrate according to aspects of the present disclosures. The rear surface of the circuit substrate 52 is an example of the other side surface of the circuit substrate according to aspects of the present disclosures.

What is claimed is:

1. A cartridge unit configured to be attachable at a recessed attachment part provided to a printer, the cartridge unit comprising:

a cartridge; and a circuit assembly, wherein the cartridge includes a casing having a cartridge bottom wall, a cartridge top wall arranged in parallel with the cartridge bottom wall and four cartridge side walls arranged between the cartridge bottom wall and the cartridge top wall, wherein, when the cartridge is in a cartridge attached state in which the cartridge is attached to the attachment part of the printer, the cartridge bottom wall configured to face a printer bottom wall of the attachment part, wherein, when the cartridge is in the cartridge attached state, a particular cartridge side wall, which is one of the four cartridge side walls, is configured to face a plurality of first electrical contacts provided to a part of a printer side wall of the attachment part and moveably urged toward the particular cartridge side wall, wherein the circuit assembly includes:

a plate-like base member; and a circuit substrate provided to the base member, the circuit substrate having a memory module storing information and a plurality of second electrical contacts exposed from a one side surface of the base member, wherein, when the cartridge is in the cartridge attached state, the circuit assembly is configured to be in a circuit assembly attached state where the circuit assembly is arranged between the plurality of first electrical contacts of the printer and the particular cartridge side wall and in a circuit assembly unattached state where the circuit assembly is not arranged between the plurality of first electrical contacts and the particular cartridge side wall, and wherein a thickness of the circuit assembly is larger than a distance between the plurality of first electrical contacts and the particular cartridge side wall in the cartridge attached state and the circuit assembly unattached state.

2. The cartridge unit according to claim 1, wherein the plurality of first electrical contacts contact the particular cartridge side wall when in the cartridge attached state and in the circuit assembly unattached state.

3. The cartridge unit according to claim 1, wherein the plurality of first electrical contacts are arranged in a direction perpendicular to a first direction which is a direction perpendicular to the cartridge bottom wall and the cartridge top wall and parallel with the particular cartridge side wall, the direction in which the plurality of first electrical contacts are arranged being a second direction, wherein the circuit assembly is configured such that:

an expansion part is provided to at least an end part on one side in the first direction of the base member, the expansion part extending in the second direction when the plurality of second electrical contacts are arranged in the second direction; and when in the cartridge attached state and in the circuit assembly attached state, the expansion part of the circuit assembly contacts the printer bottom wall of the attachment part, the plurality of first electrical contacts contacting the plurality of second electrical contacts, respectively.

4. The cartridge unit according to claim 3, wherein a length of the expansion part in the second direction is longer than a length of the circuit substrate in the second direction.

5. The cartridge unit according to claim 3, wherein the expansion part is configured to be one of:

a part provided to a portion on one side with respect to a center, in the second direction, of one side end part, in the first direction, of the base member, and not provided to a portion on an other side with respect to the center, in the second direction, of the one side end part, in the first direction, of the base member; and a part provided to a portion on the other side with respect to the center, in the second direction, of the one side end part, in the first direction, of the base member, and not provided to the one side with respect to the center, in the second direction, of the one side end part, in the first direction, of the base member.

6. The cartridge unit according to claim 3, a length, in the first direction, of the base member of the circuit assembly is longer than a length, in the first direction, of the cartridge.

7. The cartridge unit according to claim 3, wherein the cartridge includes a protruding part formed on the particular cartridge wall and protruding in the first direction, wherein the circuit assembly is configured such that an end part on the one side, in the second direction, of the base member extends in the first direction when the plurality of second electrical contacts are arranged in the second direction, wherein, when the end part on the one side, in the second direction, of the circuit assembly contacts the protruding part in the cartridge attached state and in the circuit assembly attached state, the plurality of first electrical contacts contact the plurality of second electrical contacts, respectively.

8. The cartridge unit according to claim 7,
wherein the circuit assembly is configured such that:
a cutout is formed on the base member at a corner where an end part on the one side in the first direction and an end part on the one side in the second direction intersect, and
a length, in the second direction, of the base member at a portion where the cutout is formed in the first direction is smaller toward the one side in the first direction.

9. The cartridge unit according to claim 3,
wherein the base member includes:
a base part which is parallel to the first direction and the second direction in a state where the plurality of second electrical contacts are arranged in the second direction; and
a first extension part extending in a direction perpendicular to the base part from an end part on the other side in the first direction of the base member.

10. The cartridge unit according to claim 9,
wherein, in the cartridge attached state, in the circuit assembly attached state, and in a state where the plurality of first electrical contacts respectively contact the plurality of second electrical contacts, the first expansion part is arranged on the other side, in the first direction, with respect to the plurality of second electrical contacts.

11. The cartridge unit according to claim 9,
wherein, in the cartridge attached state, in the circuit assembly attached state, and in a state where the plurality of first electrical contacts respectively contact the plurality of second electrical contacts, the first extension part faces the cartridge top wall of the cartridge from the other side in the first direction.

12. The cartridge unit according to claim 11,
wherein the base member includes:
a base part parallel with the first direction and the second direction in a state where the plurality of second electrical contacts are arranged in the second direction; and
a second extension part extending in a direction perpendicular to the base part from an end part of the base part on the other side in the second direction, and
wherein, in the cartridge attached state, in the circuit assembly attached state, and in a state where the plurality of first electrical contacts respectively contact the plurality of second electrical contacts, the second expansion part faces the other side of the second direction with respect to one of the four cartridge side walls adjoining the particular cartridge side wall on the other side in the second direction.

13. The cartridge unit according to claim 3,
wherein the circuit assembly has a first engaging part provided on the other side surface of the base member and extending in the first direction in a state where the plurality of second electrical contacts are arranged in the second direction,
wherein the cartridge includes a second engaging part provided to the particular cartridge side wall, the second engaging part extending in the first direction in the cartridge attached state, the second engaging part engaging with the first engaging part in the cartridge attached state and the circuit assembly attached state.

14. The cartridge unit according to claim 3,
wherein the circuit assembly includes a tapered part arranged on the one side in the first direction of the base member with respect to the plurality of second electrical contacts in a state where the plurality of second electrical contacts arc arranged in the second direction, the thickness of the tapered part being smaller at a position closer to the one side in the first direction than to the other side in the first direction.

15. The cartridge unit according to claim 1,
wherein the plurality of second electrical contacts are provided to a one side surface of the circuit substrate,
wherein the memory module is provided to an other side surface of the substrate,
wherein an end part of the memory module on a one side in a perpendicular direction which is a direction perpendicular to the circuit substrate is closer to a position of the one side surface of the circuit substrate than another end part of the memory module on an other side in the perpendicular direction, and
wherein a maximum value of a distance between the one side surface of the circuit substrate and the end part on the other side, in the perpendicular direction, of the memory module is smaller than a maximum value of a distance between the one side surface of the circuit substrate and the end part on the other side, in the perpendicular direction, of the base member.

16. A circuit assembly for a cartridge unit configured to be attachable at a recessed attachment part provided to a printer, the cartridge unit also including a cartridge,
wherein the cartridge includes a casing having a cartridge bottom wall, a cartridge top wall arranged in parallel with the cartridge bottom wall and four cartridge side walls arranged between the cartridge bottom wall and the cartridge top wall,
wherein, when the cartridge is in a cartridge attached state in which the cartridge is attached to the attachment part of the printer, the cartridge bottom wall is configured to face a printer bottom wall of the attachment part,
wherein, when the cartridge is in the cartridge attached state, a particular cartridge side wall, which is one of the four cartridge side walls, is configured to face a plurality of first electrical contacts provided to a part of a printer side wall of the attachment part and moveably urged toward the particular cartridge side wall,
wherein the circuit assembly includes:
a plate-like base member; and
a circuit substrate provided to the base member, the circuit substrate having a memory module storing information and a plurality of second electrical contacts exposed from a one side surface of the base member,
wherein, when the cartridge is in the cartridge attached state, the circuit assembly is configured to be in a circuit assembly attached state where the circuit assembly is arranged between the plurality of first electrical contacts of the printer and the particular cartridge side wall and in a circuit assembly unattached state where the circuit assembly is not arranged between the plurality of first electrical contacts and the particular cartridge side wall, and
wherein a thickness of the circuit assembly is larger than a distance between the plurality of first electrical contacts and the particular cartridge side wall in the cartridge attached state and the circuit assembly unattached state.

17. A cartridge attaching method of attaching the cartridge and the circuit assembly to a recessed attachment part provided to a printer, the cartridge including a casing having a cartridge bottom wall, a cartridge top wall arranged in parallel with the cartridge bottom wall and four cartridge side walls arranged between the cartridge bottom wall and the cartridge top wall, wherein, when the cartridge is in a cartridge attached state in which the cartridge is attached to the attachment part of the printer, the cartridge bottom wall is configured to face a printer bottom wall of the attachment part, wherein, when the cartridge is in the cartridge attached state, a particular cartridge side wall, which is one of the four cartridge side walls, is configured to face a plurality of first electrical contacts provided to a part of a printer side wall of the attachment part and moveably urged toward the particular cartridge side wall, the circuit assembly including a plate-like base member, and a circuit substrate provided to the base member, the circuit substrate having a memory module storing information and a plurality of second electrical contacts exposed from a one side surface of the base member, wherein, when the cartridge is in the cartridge attached state, the circuit assembly is configured to be in a circuit assembly attached state where the circuit assembly is arranged between the plurality of first electrical contacts of the printer and the particular cartridge side wall and in a circuit assembly unattached state where the circuit assembly is not arranged between the plurality of first electrical contacts and the particular cartridge side wall, and wherein a thickness of the circuit assembly is larger than a distance between the plurality of first electrical contacts and the particular cartridge side wall in the cartridge attached state and the circuit assembly unattached state, the method including:

a first process of attaching the cartridge to the attachment part such that the particular cartridge side wall of the cartridge and a part of the printer side wall of the attachment part of the printer face each other; and a second process of inserting the circuit assembly between the particular cartridge side wall and the plurality of first electrical contacts such that the plurality of second electrical contacts contact the plurality of first electrical contacts, respectively.

18. A circuit assembly employed in a printing system including a thermal printer and a cartridge, the cartridge having a casing provided with a cartridge bottom wall, a cartridge top wall parallel with the cartridge bottom wall, and four cartridge side walls arranged between the cartridge bottom wall and the cartridge top wall, the thermal printer having an attachment part having a recessed shape, a thermal head provided to the attachment part, and a plurality of first electrical contacts, the attachment part having a printer bottom wall configured to face the cartridge bottom wall in a cartridge attached state in which the cartridge is attached to the thermal printer and a printer side wall, the plurality of first electrical contacts being configured to be movably biased toward a particular cartridge side wall which is one of the four cartridge side walls in the cartridge attached state, wherein the circuit assembly is configured to be in a circuit assembly attached state which is a state where the circuit assembly is arranged between the plurality of first electrical contacts of the thermal printer and the particular cartridge side wall of the cartridge in the cartridge attached state, wherein the circuit assembly comprising:

a plate-like base member; and a circuit substrate provided to the base member, the circuit substrate including a memory module storing information, and a plurality of second electrical contacts exposed on a one side surface of the base member, and wherein a thickness of the circuit assembly is larger than a distance between the plurality of first electrical contacts and the particular cartridge side wall in the cartridge attached state and a circuit assembly unattached state where the circuit assembly is not arranged between the plurality of first electrical contacts and the particular cartridge side wall.

19. The circuit assembly according to claim 18, wherein the plurality of first electrical contacts are arranged in a direction perpendicular to a first direction which is a direction perpendicular to the cartridge bottom wall and the cartridge top wall and parallel with the particular cartridge side wall, the direction in which the plurality of first electrical contacts are arranged being a second direction, wherein the circuit assembly is configured such that:

an expansion part is provided to at least an end part on one side in the first direction of the base member, the expansion part extending in the second direction when the plurality of second electrical contacts are arranged in the second direction; and when in the cartridge attached state and in the circuit assembly attached state, the expansion part of the circuit assembly contacts the printer bottom wall of the attachment part, the plurality of first electrical contacts contacting the plurality of second electrical contacts, respectively, wherein the circuit assembly is configured such that:

a cutout is formed on the base member at a corner where an end part on the one side in the first direction and an end part on the one side in the second direction intersect, and a length, in the second direction, of the base member at a portion where the cutout is formed in the first direction is smaller toward the one side in the first direction.

20. The circuit assembly according to claim 19, wherein the base member includes:

a base part which is parallel to the first direction and the second direction; and a first extension part extending from an end part on the other side in the first direction of the base member, the first expansion part being arranged on the other side, in the first direction, with respect to the plurality of second electrical contacts in the cartridge attached state, in the circuit assembly attached state, and in a state where the plurality of first electrical contacts respectively contact the plurality of second electrical contacts.

21. The circuit assembly according to claim 19, wherein the base member includes:

a base part which is parallel to the first direction and the second direction; and a first extension part extending from an end part on the other side in the first direction of the base member, the first extension part facing the cartridge top wall of the cartridge from the other side in the first direction in the cartridge attached state, in the circuit assembly attached state, and in a state where the plurality of first electrical contacts respectively contact the plurality of second electrical contacts.

22. The circuit assembly according to claim 19, wherein the base member includes:

a base part parallel with the first direction and the second direction; and a second extension part extending from an end part of the base part on the other side in the second direction, the second expansion part facing the other side of the second direction with respect to one of the four cartridge side walls adjoining the particular cartridge side wall on the other side in the second direction in the cartridge attached state, in the circuit assembly attached state, and in a state where the plurality of first electrical contacts respectively contact the plurality of second electrical contacts.

* * * * *